US006661340B1

(12) United States Patent
Saylor et al.

(10) Patent No.: US 6,661,340 B1
(45) Date of Patent: Dec. 9, 2003

(54) SYSTEM AND METHOD FOR CONNECTING SECURITY SYSTEMS TO A WIRELESS DEVICE

(75) Inventors: Michael J. Saylor, McLean, VA (US); Alison Slavin, Arlington, VA (US); Jean-Paul Hugues Martin, Oakton, VA (US)

(73) Assignee: Microstrategy Incorporated, McLean, VA (US)

( * ) Notice: Subject to any disclaimer, the term of this patent is extended or adjusted under 35 U.S.C. 154(b) by 81 days.

(21) Appl. No.: 09/840,302

(22) Filed: Apr. 24, 2001

(51) Int. Cl.[7] ..... G08B 23/00

(52) U.S. Cl. ..... 340/517; 340/521; 340/539.22; 340/539.26; 340/541; 340/825.36; 340/7.52; 340/7.59

(58) Field of Search ..... 340/517, 521, 340/540, 541, 539, 825.36, 825.44, 825.45, 539.1, 539.14, 539.16, 539.22, 539.26, 7.52, 7.59

(56) References Cited

U.S. PATENT DOCUMENTS 4,446,454 A * 5/1984 Pyle ..... 340/538
4,581,606 A * 4/1986 Mallory ..... 340/539
4,777,474 A 10/1988 Clayton
5,027,104 A 6/1991 Reid
5,027,383 A 6/1991 Sheffer
5,091,780 A 2/1992 Pomerleau
5,111,291 A 5/1992 Erickson et al.
5,195,126 A * 3/1993 Carrier et al. ..... 379/45
5,438,607 A * 8/1995 Przygoda, Jr. et al. ..... 379/38
5,471,239 A 11/1995 Hill et al.
5,499,014 A 3/1996 Greenwaldt
5,581,297 A 12/1996 Koz et al.
5,621,385 A 4/1997 Carney
5,638,046 A 6/1997 Malinowski
5,717,379 A 2/1998 Peters
5,731,832 A 3/1998 Ng
5,777,551 A 7/1998 Hess
5,831,669 A 11/1998 Adrain
5,861,804 A 1/1999 Fansa et al.
5,867,105 A 2/1999 Hajel
5,892,442 A 4/1999 Ozery
5,926,210 A 7/1999 Hackett et al.
6,032,036 A 2/2000 Maystre et al.
6,035,016 A * 3/2000 Moore ..... 379/45
6,038,289 A 3/2000 Sands
6,049,272 A 4/2000 Lee et al.
6,049,273 A 4/2000 Hess
6,049,353 A 4/2000 Gray
6,052,052 A 4/2000 Delmonaco
6,067,346 A 5/2000 Akhteruzzaman et al.
6,067,571 A 5/2000 Igarashi et al.
6,069,655 A 5/2000 Seeley et al.
6,091,771 A 7/2000 Seeley et al.
6,097,429 A 8/2000 Seeley et al.
6,108,034 A 8/2000 Kim
6,133,830 A 10/2000 D'Angelo et al.
6,295,346 B1 * 9/2001 Markowitz et al. .... 379/127.01
6,369,705 B1 * 4/2002 Kennedy ..... 340/506
6,400,265 B1 6/2002 Saylor et al.

* cited by examiner

*Primary Examiner*—Toan Pham
(74) *Attorney, Agent, or Firm*—Hunton & Williams LLP

(57) ABSTRACT

The present invention provides a personal security network where an individual's system or systems of security devices may be connected to a central security network. The central security network of the present invention may monitor a system's status and alert the individual when an alert situation occurs. The present invention provides a security network where a user may set up personalized alarms and alert services; identify various methods of contact; order at which to be contacted; individuals and entities to be contacted; type of situations to be alerted of and other relevant security and other information. The present invention may further provide a personalized web interface where authorized individuals may view current and historical security device status. A user may generate personalized reports based on aggregated historical data based on various user-defined factors. The reports may be displayed to the user in various formats, such as maps, graphs, statistics, and others.

44 Claims, 14 Drawing Sheets

SYSTEM AND METHOD FOR CONNECTING SECURITY SYSTEMS TO A WIRELESS DEVICE

FIELD OF INVENTION

The present invention relates generally to the field of security systems, in particular to a system and method for connecting a security system to a wireless communication system to automatically inform an owner and other authorized entities in a manner predetermined by the user when alarm situations and/or alarm worthy situations occur.

BACKGROUND OF THE INVENTION

Home security and personal safety are major concerns for individuals. People want to protect their valuables and provide a safe haven for family members and loved ones. Traditional home security systems generally alert neighbors and others within the vicinity with a loud noise warning the intruder or intruders that the invasion has been detected. In addition, home alarms generally inform a home security central system of the unauthorized entry. The home security central system then alerts the police and/or third party security companies that an unauthorized entry has occurred. Home security devices generally involve window detectors, door detectors, motion sensors and other devices.

High false alarm rates pose a serious problem in communities. False alarms deplete police resources and undermine the credibility of systems that appear to repeatedly malfunction. In response to the high number of false alarms (over 90% in some areas), counties and other localities may fine alarm owners whose systems repeatedly produce false alarms in an attempt to reduce staggering false alarm rates. In some communities, laws have been passed that prevent the police from responding to an alarm activated by a security system. As a result, alarm owners may be forced to employ expensive third party security companies to respond to alarm situations.

Some systems may place a confirmation call or communication to the owner before dispatching the police or other security entity. This may be helpful when the owner is at home to explain that the alarm was a false alarm thereby preempting the alarm and police dispatch. In other situations, the alarm may have been triggered inadvertently by a pet, falling branch or other innocent act while the home owner is away. In such an event, an attempt to make a confirmation call to the owner at home is ineffective. Traditional central alarm systems often fail to proactively contact a home owner while the home owner is in transit. In addition, power failures and other power cutoffs may prevent traditional alarm systems from contacting a user in the event of an alarm situation.

Currently, home security systems offer limited services. Generally, all alarm situations are treated in the same manner. The industry itself has remained stagnant and inflexible. Generally, current security services are confined to sounding an alarm and/or dispatching the police or other security entity. Depending on the type of event detected, a user may desire responses in varying degrees of severity. Similar problems .exist with other security systems for office buildings, cars, boats, vaults and other objects or locations.

These and other drawbacks exist with current systems.

SUMMARY OF THE INVENTION

The present invention provides a security system connected to a wireless communication system which enables communication with a subscriber user when an alarm (or other defined) situation occurs. The security system may be applied to a user's home, office, vacation house or other location. The security system may also be applied to a user's mobile property, such as a car, boat or other personal property. In addition, a security system may encompass personal security devices for individuals, such as a panic device.

According to one embodiment, the present invention provides a personal security network where one or more security devices related to a subscriber may be connected to a central security network over wireless communication. The central security network of the present invention may monitor those security devices and alert a user when an alert situation occurs. The user may set up personalized alarms and alert services; identify various methods of contact; identify the order at which to be contacted; individuals and entities to be contacted; select the type of situations for which they want to be alerted and provide other relevant security and other information.

A personalized web interface (e.g., Internet, wireless web, PDA web, etc.) may also be provided through which a user and authorized individuals may view current and historical security device status. A user may initiate contact with a web interface to conveniently view and/or monitor data for registered alarm sensors at various locations, zones, etc. A user may also generate personalized reports or have those reports automatically generated for them from aggregated historical data and other information based on user defined factors, such as area of interest, type of event(s), time frame(s) and other factors. The reports may be displayed to the user in various formats, such as maps, graphs, statistics, and others formats.

According to this or other embodiment, the present invention may further provide a monitoring system for providing images (e.g., photos, pictures, video, diagrams, illustrations, etc.) where an alarm situation may be detected by comparing images. When a change in images (indicating motion) is detected, an alarm may be signaled. In addition, the image and other information may be conveyed to a central security network where identified individuals may be alerted via identified methods. The user may also view the images (e.g., video clips) remotely via the web or other remote access methods.

Users may also monitor and/or control appliances and objects remotely via a wireless channel, which may also be the channel used to send alarm events, alarm broadcasts and other information.

According to another embodiment of the present invention, the system of the present invention provides a wireless communication device at a home security system which relays a wireless communication from the home security device directly to the user's desired devices in such a way so that power failures and other power cutoff situations do not prevent the relay of information to the owner and other points of contact.

Additional advantages of the invention will be set forth in part in the description which follows, and in part will be apparent from the description, or may be learned by practice of the invention. The advantages of the invention may be realized and attained by means of the instrumentalities and combinations particularly pointed out in the appended claims.

The accompanying drawings, which are incorporated in and constitute a part of this specification, illustrate various embodiments of the invention and, together with the description, serve to explain the principles of the invention.

DETAILED DESCRIPTION OF THE PREFERRED EMBODIMENTS

The present invention may provide a security system where a user may personalize alert notifications for various security devices and/or systems. The present invention may also provide access to a web interface (e.g., personal web page) where a user may monitor current security status and other information. Historical data may also be available for the user to generate reports based on aggregate data from security systems within the network and/or other sources of data. A user may register security devices and/or systems with the central security network of the present invention. The central security network may access the user's personal preferences, profile information and/or other information which may be used to execute notifications in the manner specified by the user. For example, the user may identify various personal preferences, which may include contact information, contact individuals, methods of communication, order of contact, special instructions and other information.

For example, when an alert situation is detected, a security device may inform a local control panel, which may then inform a central security network. The user may be informed of an alarm situation and/or alarm worthy situations via web, WAP, voice and other methods of communication, depending on the user's preferences, permissions and/or other information.

According to an embodiment of the present invention, a central security system may include a network where a user may benefit from information from and connection to other users. For example, the system may immediately notify a user about burglar strikes (or other user identified alarm situation) in the user's neighborhood or defined area (radius of interest or other location). The present invention may further provide preventive information when a user is notified of alarm information or other predefined situations.

Users may sign up for services that contact the user (and/or other authorized individuals and/or entities) when an alarm goes off in the user's system, when an alarm worthy situation is predicted (or otherwise detected) by the network, when a neighbor is experiencing an alarm situation and/or at the occurrence of other events. The conditions setting off an alarm, the content of the alarm service, and list of recipients who may be contacted in the event of an alarm, may be personalized and updated through a web site (or other user interface system) of the present invention.

Figure 1:
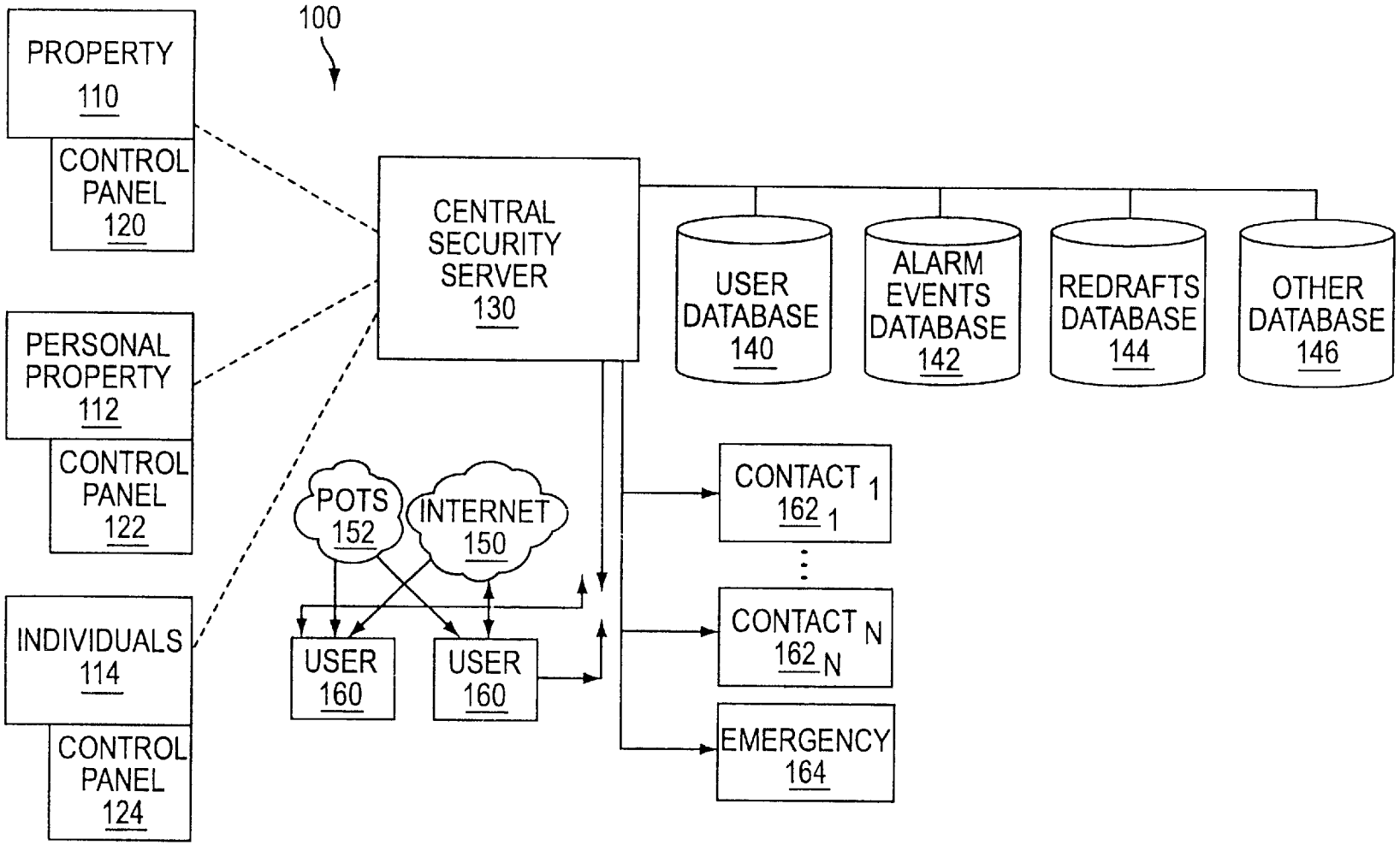
FIG. 1 is a graphical representation of a security system with wireless access, according to an embodiment of the present invention.

FIG. 1 is a graphical representation of a central security network system 100, according to an embodiment of the present invention. A user may register various types of security devices, including those associated with property 110, personal property 112 and/or individuals 114 with the central security network 130 of the present invention. Alarm situations may be detected by a control panel 120, 122, 124 associated with and preferably local to each security device and/or system (e.g., property, personal property, individual, or combination). Control panels 120, 122, 124 may transmit alarm information to central security network 130. Central security network 130 may process the alarm situation, status data and/or other relevant information.

Databases 140, 142, 144 and 146 may store relevant information for personalized alarm services. While shown as separate databases, it should be appreciated that the contents of these databases may be combined into fewer or greater numbers of databases and may be stored on one or more data storage systems. User information may be obtained from user database 140. Alarm events and other information may be stored in alarm events database 142. A user may generate reports based on historical and/or other data which may be stored in reports database 144. Other information may be accessed and/or stored in other database 146. Based on user preferences and other information, the user may be notified via various methods of communication, as specified in the user's profile and preferences information. Alert notification may be communicated via the Internet 150, POTS 152, wireless communication portals, voice portals, and/or other methods. Contact individuals and/or entities $\mathbf{162}_1$–$\mathbf{162}_N$ identified by the user may also receive alert notification in an order determined by the user. The contact order and other actions may be predetermined. In addition, the user may select contact.order and/or other actions through menu options at the time of alarm situation notification. An emergency entity 164, such as police, fire department, and/or rescue squads, may receive alert information.

A user may subscribe security systems associated with various objects within the central security network 130 of the present invention. The security system may be applied to property 110, personal property 112, individuals 114 and other objects. Property 110 may include user's home, office, vacation house or other locations. The security system may also be applied to a user's personal property 112, such as a car, boat or other mobile property. A security system may encompass personal security devices for individuals 114, such as a panic device. Other objects, locations, and property may be protected.

Various security devices may be associated with each location, item of personal property, or individual within the central security network of the present invention. For property 110, security devices may include sensors, detectors and/or other devices for detecting alarm situations. For personal property 112, security devices may include global positioning devices associated with devices capable of sensing and/or detecting alarm situations. For individuals 114, security devices may include a panic button or other similar device. Other security devices may be implemented with the system of the present invention. For example, wireless panic buttons with GPS transponders may be available as stand alone devices and may be built into mobile phones, cars, walkmen, bicycles, wristwatches and/or other portable or mobile devices. Thus, a user may alert the authorities any time the user is in danger, from anywhere, and transmit location information detailing the user's position and/or other information. Other variations may be implemented.

According to an embodiment of the present invention, security devices may be predominantly wireless and communicate locally over short-range radio or other modes of communication. Each of the sensors (or group of sensors) may be equipped with a transmitter and the control panel may be equipped with a receiver. A control panel of the present invention may receive regular status information from the sensors and may be alerted when a sensor detects an alarm situation. Other information may be received by the control panel. Transmission of regular status information may occur at predetermined intervals, as well. For example, the sensors may send digital data packets providing status and other data at 10 second intervals. Also, on or off status information may be conveyed to central security network 130.

When an alarm situation is detected, a local control panel 120 or other similar device may communicate to a central security network 130 of the present invention. Control panels 120 may serve as a link between an alarm system (for each property, personal property, individual, or combination) and a central security network of the present invention. Communication may be established through various mediums. An example may include a radio modem (e.g., CreateaLink 2XT radio modem) which may transmit radio waves at a predetermined frequency (e.g., 900 MHz) which may then be received by central security network 130 or at an intermediary system that relays the signal over a secondary communication channel (e.g., TCP/IP system) to central security network 130. Other examples of modes of communication may include POTS (plain old telephone service), cable modem, DSL (digital subscriber links), wireless (two-way pager, packet switched, telephone cellular networks) and others.

Figure 2:
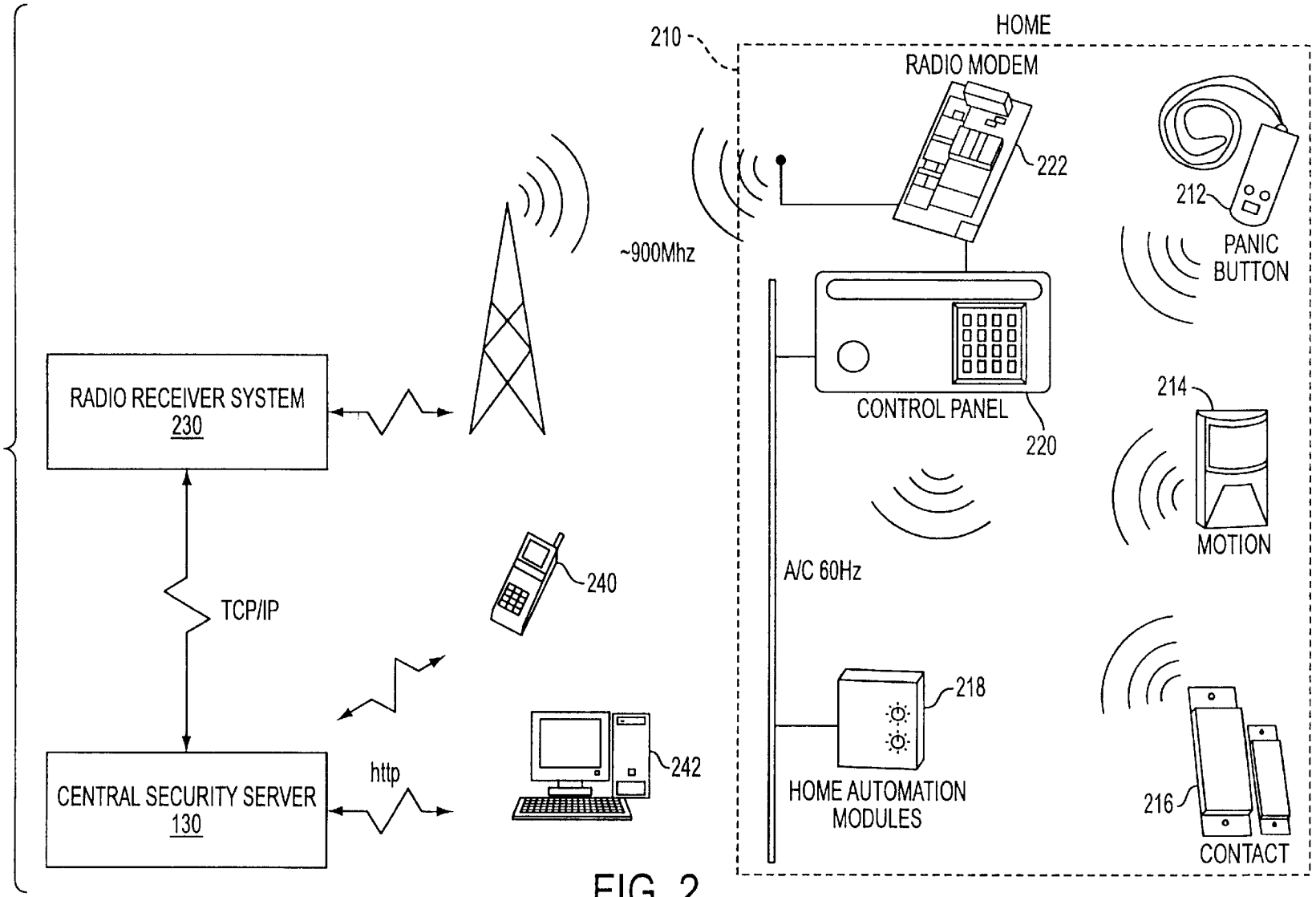
FIG. 2 is an example of an alarm transmission, according to an embodiment of the present invention.

FIG. 2 is an example of an alarm transmission, according to an embodiment of the present invention. A location, such as home 210, may include various security and/or other devices, such as panic button 212, motion sensor 214, motion contact 216, home automation modules 218, which communicate with control panel 220. Control panel 220 may send a signal via radio modem 222 to radio receiver system 230. For example, radio modem 222 may transmit alarm and other data at a frequency of approximately 900 Mhz. Other frequencies may also be transmitted and detected. Radio receiver system 230 may then communicate with central security server 130 via a TCP/IP connection. Other communication techniques may be implemented. Central security server 130 may then alert users and other identified entities via wireless and/or other devices, such as mobile device 240, via a voice alarm, text message and other notifications. For example, alerts may be transmitted to the user via email or other form of electronic communication to a personal computer 242 or other device. In addition, users may check status and other data via mobile device 240, computer 242 and other devices.

Figure 3:
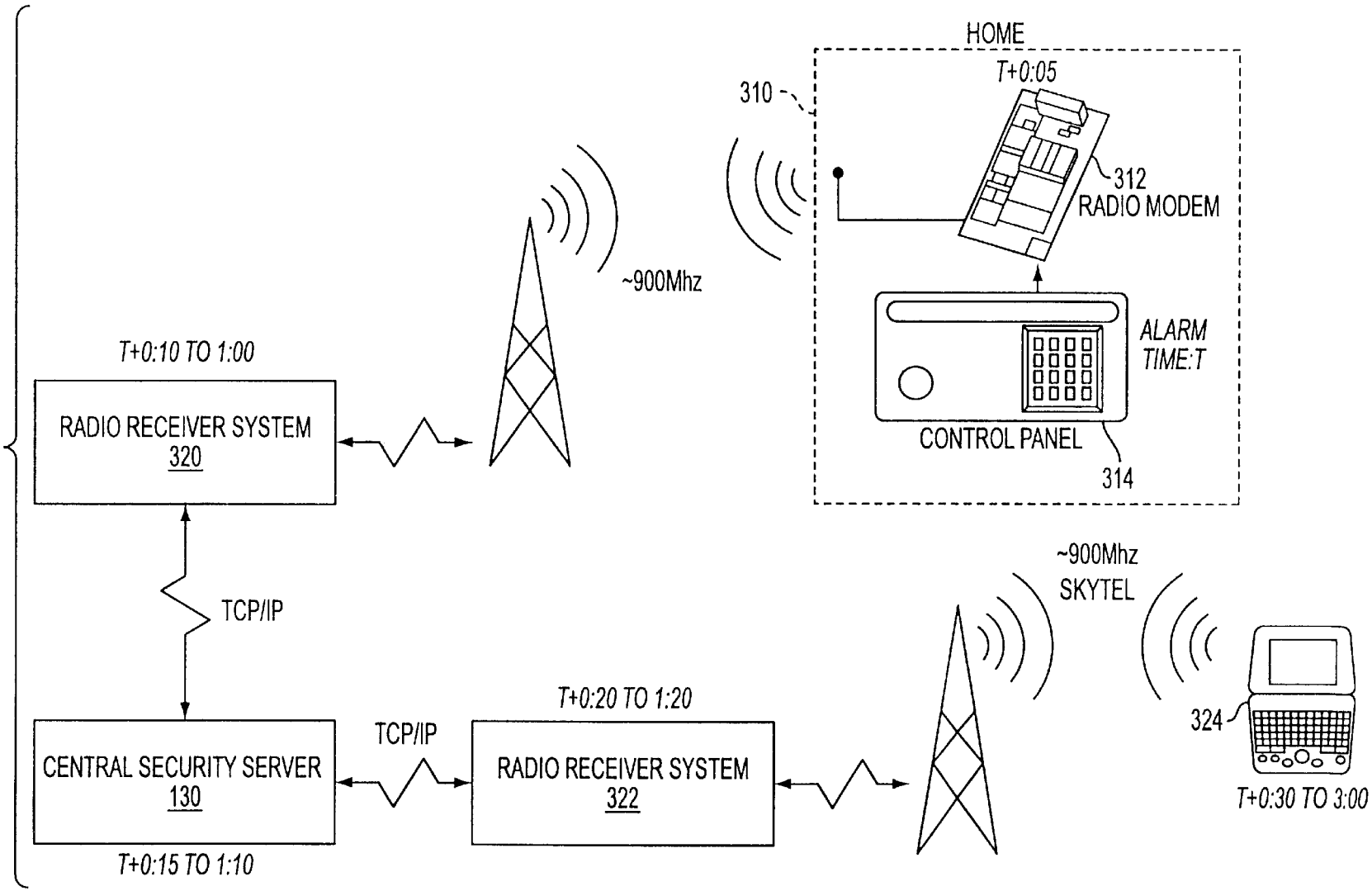
FIG. 3 is an example of alarm propagation, according to an embodiment of the present invention.

FIG. 3 is an example of alarm propagation, according to an embodiment of the present invention. The alarm system of the present invention provides an efficient method for transmitting an alarm situation and promptly notifying a user and/or other identified entity. According to an example of the present invention, alarm data may be transmitted from control panel 314 to a user's mobile or other device at approximately 30 seconds to approximately 3 minutes. At time T, control panel 314, located at home 310 or other location, may communicate alarm data to radio modem 312, at time T+0:05. Radio receiver system 320 may receive the transmitted data at time T+0:10 to 1:00. Communication to central security server 130 may be established at time T+0:15 to 1:10. Communication to radio receiver system 322 may be established at time T+0:20 to 1:20. At time T+0:30 to 3:00, alarm data may be transmitted to a user's device, such as a two-way pager 324.

According to an embodiment of the present invention, the central security network may provide wireless backup for one or more communication connections. For example, the present invention may include a combination of a POTS connection with wireless back-up. In the event of an alarm, the control panel may attempt to use the phone line to transmit data to a central security network. If data transmission via POTS is unsuccessful (e.g., if someone were using the phone), the control panel may send the data wirelessly to the central security network. In another example, a user may integrate still or motion video into an alarm system through the use of a broadband landline (e.g., cable or DSL) for image transmission with a wireless connection to send alarm data. Other combinations may be implemented.

According to an embodiment of the present invention, control panel 120 may transmit alarm information to central security network 130 at the detection of an alarm situation. Various user defined options may be available. For example, control panel 120 may trigger an alarm sound when an alarm situation has been detected. Based on user defined preferences, a user may be notified before the sounding of an alarm and before contacting an emergency entity (e.g., police, ambulance, etc.) to reduce false alarm penalties and fees. In addition, control panel 120 may trigger an alarm sound and confirm with the user via notification methods where the user may terminate the alarm sound if determined to be false, before an emergency entity has been contacted. Thus, the user may specify that an alarm sound be triggered but police notification to be confirmed by the user before dispatch. In another example, if the user cannot be contacted for confirmation within a predetermined time frame, the system may automatically contact an emergency entity. The user may personalize various parameters and responses based on the alarm situations involved. Other variations may be implemented.

Central security network 130 may process the alarm situation. User profile information may be retrieved from user database 140. User database 140 may contain user information, such as profile information, user preferences, contact information, special instructions and/or other information. User profile information may include one or more of name, identification information, address information, and other profile information. User preferences may include mode of communication, order of communication, contact information and other preferences. User preference information may be associated with each security device, group of devices, systems or other combinations. For example, different alarm situations that may be detected in various locations or systems may warrant different levels of response. In addition, a user may maintain a personal address book where contact information (e.g., phone, pager, mobile device, etc.) associated with various individuals may be stored and accessed based on various identified alarm situations and/or potential alarm situations. Special instructions may include information to be conveyed to entities reacting to the alarm for a particular location or object. For example, when a fire detector is activated, the user may want to inform the fire department that the user has two pets living at the user's primary residence. Other instructions for different registered locations, objects and/or individuals may be stored and conveyed to entities reacting to the alarm situation per the user's instructions or preferences.

In another embodiment of the present invention, the functions described herein for central security server 130 may be provided in each security device and/or control panel. In that embodiment, each individual security device and/or control panel may initiate notification wirelessly directly to the user based on user notification preferences and data detected at the security device(s). Information from the individual security devices may still be transmitted to a central system to store as part of aggregate data discussed in more detail below.

Alarm events database 142 may contain historical alarm and/or other data. Alarm events database 142 may maintain data related to alarm events and other alarm worthy situations within a network and/or community. Other information may be stored and other sources of information may be accessed. This data may be used to generate reports based on aggregated data. For example, a user may request a report regarding home burglaries or other break-ins within a 10 mile radius of the user's primary home for the past 6 months. Other locations, time frames and factors may be identified in generating a report. Maps, charts and/or other graphics may be used to display historical alarm data based on user specifics.

Reports database 144 may contain a repository of user generated reports. These reports may be modified by the user at later times. Also, a user may request periodic updates on generated reports at predetermined intervals of time. Other information may also be requested.

Based on user information retrieved from one or more databases 140, 142, 144 and 146, central security network 130 may contact one or more users 160 or other identified contacts $\mathbf{162}_1$–$\mathbf{162}_N$ as specified by the user. Other identified contacts may include neighbors, family members, personal doctors, emergency entities 164, such as the police, fire department, hospital and others.

Figure 4:
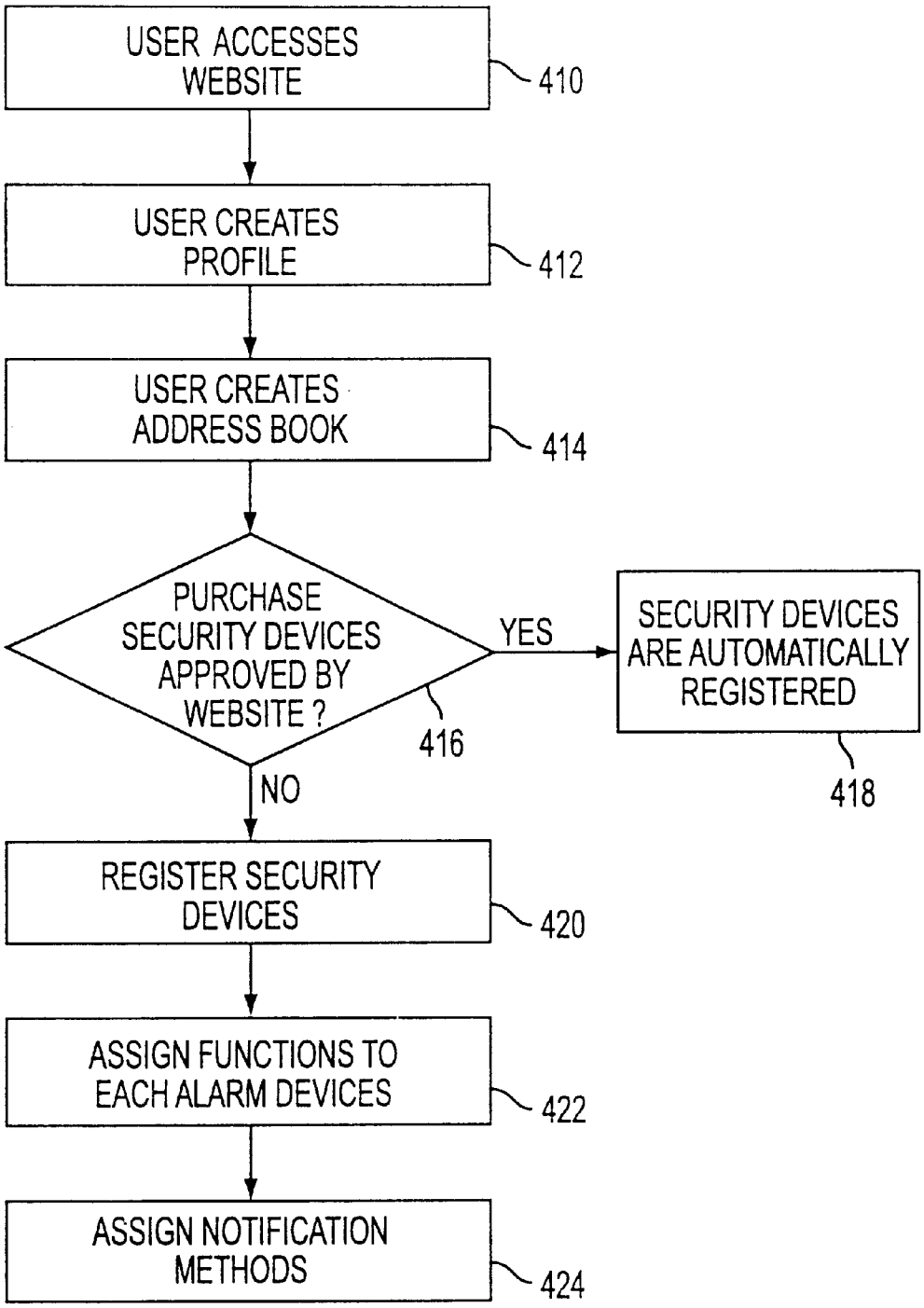
FIG. 4 is a flowchart illustrating a subscription process, according to an embodiment of the present invention

FIG. 4 is a flowchart illustrating a subscription process, according to an embodiment of the present invention. At step 410, a user may access a web site of the present invention. At step 412, a user may create a profile with customized options. At step 414, a user may create a personalized address of contact information. At step 416, it may be determined whether security devices are purchased from the web site. If so, security devices may be automatically registered, at step 418. If not, security devices may be registered with a central security network, at step 420. At step 422, functions may be assigned to each alarm device or group of alarm devices. At step 424, notification methods may be specified. The steps of FIG. 4 will be described in further detail below.

As illustrated by step 410, a user may access a web site or other user interface associated with a central security network of the present invention. A user may create a subscription with an operation of a central security network by accessing an associated web site via Internet 150. Other methods of connecting the central security network may also be implemented (e.g., telephone registration, mail registration, etc.). The user may select a login and password or other secure access and information retrieval associated with the user. Other security features may also be implemented.

The user may create a profile, at step 412, which may include user identification information (e.g., name), address information, contact information (e.g., phone number, mobile phone number, etc.), email address, billing information and other information.

At step 414, a user may create an address book, which may include a collection of contact information for various individuals or entities identified by the user. For example, the user may provide contact information for various neighbors. In the event of a fire alarm, the present invention may notify the neighbors of the location at which a fire has been detected. In the event that an elderly family member hits a panic button, a family doctor may be contacted and given relevant information regarding the patient's current status.

The user may have the option of purchasing an entire customized security system and/or individual security devices from the present invention. At step 416, it may be determined whether security devices or security systems are approved by (e.g., purchased from) a central security network (or other authorized entity associated with the central security network). If so, security devices or systems purchased from the central security network. (or other authorized entity) may be automatically registered with central security network, as illustrated by 418. The user may receive the security devices and install such devices without having to register them specifically.

Device packages offering different levels of security may be available for purchase on the web site or through an independent provider. A user may purchase devices a la carte, in predefined packages at varying levels of security, or any combination. For example, if an individual purchases a system (individual device or combination of devices) from the web site, the system (individual device or combination of devices) may be automatically registered to that user.

If the user has an existing security system or devices or purchased such devices and/or systems from other entities, the user may register these security devices and/or systems, at step 420. For example, the user may register each security device, system or other combination for each property (e.g., house, business, vacation house, etc.), personal property (e.g., car, boat, mobile home, etc.), individual (e.g., spouse, child, grandparent, etc.) and others. For each identified property, personal property, individual or other, the associated security devices may be registered, at step 420.

For example, within a house, a user may have window and door contacts, smoke detectors and motion sensors, video cameras, key chain control, temperature monitors, CO and other gas detectors, vibration sensors, and others. A user may have flood sensors and other detectors on a boat. An individual, such as an ill or elderly grandparent, may have access to a panic transmitter or other alarm transmitter. Other sensors and/or detectors may also be included. The user may register security devices on a central security network by entering the identification code for each registered device and/or system. Other methods of identifying devices, control panels and systems may also be used.

Thus, the central security network of the present invention may also support users who already have an alarm system in their home, or want to buy a system from an alarm dealer and have it professionally installed. The central security network of the present invention may serve as a primary, secondary or other monitoring service.

At step 422, the user may assign various functions to each security device associated with each security system for property, personal property, individuals and others. A user may identify various alarm situations which may include fire (e.g., detected by a smoke alarm), intrusion or break-in (e.g., detected by motion sensors, window contacts, door contacts, etc.), tampering with valuables held in a safe or vault (e.g., detected by vibration sensor, motion sensors, contacts, etc.), assault or danger (e.g., detected by panic button, etc.), dangerous gas levels (e.g., detected by CO or other gas detector, etc.), and other alarm situations or alarm worthy situations.

The user may also request to receive network alerts. Network alerts may be based on alert notifications associated with property, personal property and/or individuals within a defined area or locality. For example, a user may request to receive alert notification that a house in the user's neighborhood was burglarized. This notification may be conveyed in an email or other personalized method of notification. Other variations and options may be implemented.

At step 424, the user may identify notification specifics for each alarm or group of alarms for each system (e.g., property, personal property, individual, etc.). For example, notification specifics may include the methods of notification desired, the order of notification, a list of individuals and/or entities to be notified and other notification information. For example, in the event of a burglary or break-in, the user may request to be notified via cell phone (or other mobile device) where the system may continuously dial the cell phone number until the user answers to respond to the alarm. The user's response may include confirmation of the alarm event, cancellation of the alarm, and other action. The user may also specify that the system should attempt to contact the user through various forms of communication until an answer is received.

In addition, a user may indicate an order of notification or priority. For example, if a user (or owner) cannot be reached, the system may be instructed to contact the next contact entity on the user's order of notification, such as a spouse, relative or neighbor.

A user may also assign various methods of notification for each alarm event or group of alarm events. Methods of notification may include cell phone, regular phone, pager, PDA, email, instant messenger, or other form of communication.

Users may also have the option of inserting comments to be passed on to the authorities (or other emergency entity) should the central security network need to contact them. For example, if an ailing or elderly person hits their panic button, the central security network may call 911 (or other emergency unit) and pass on pertinent health information.

Figure 5:
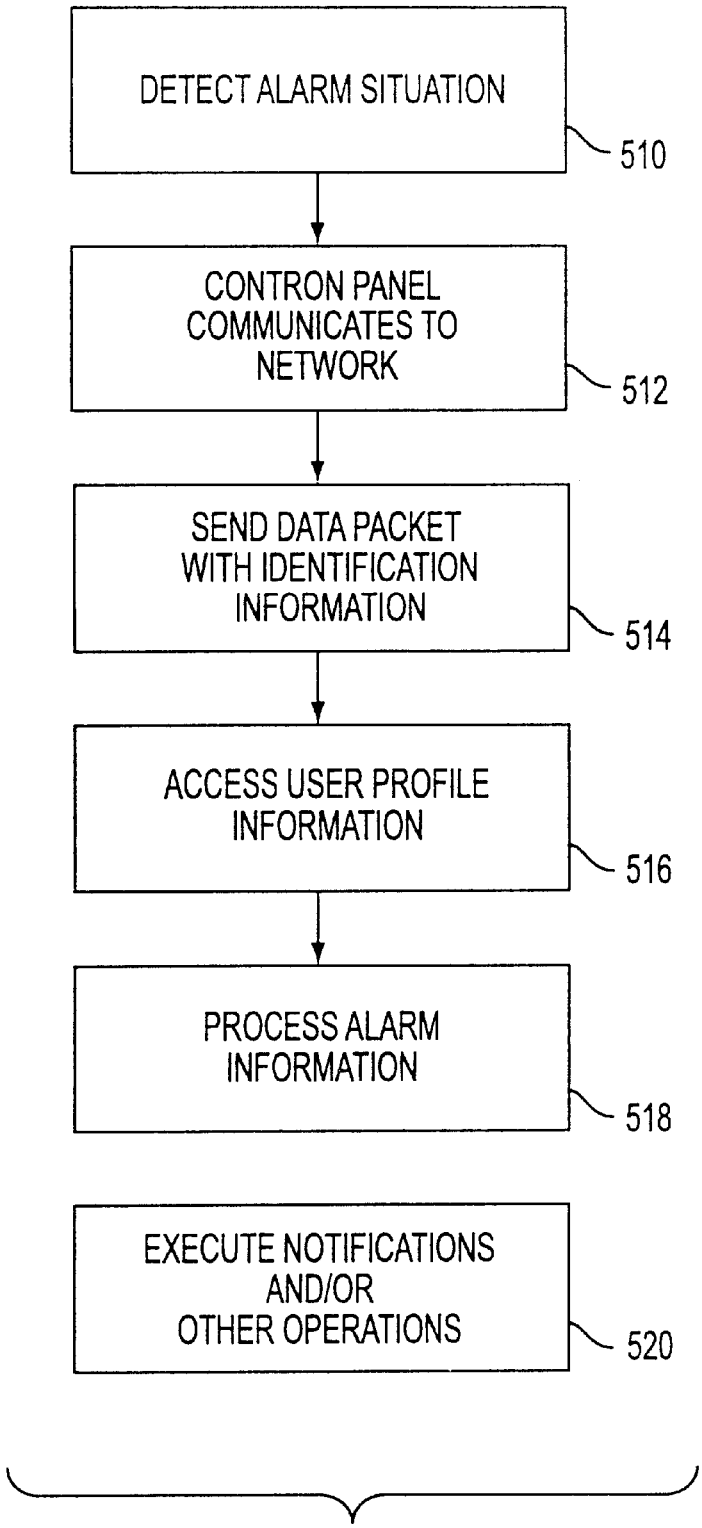
FIG. 5 is a flowchart illustrating an alarm activation process, according to an embodiment of the present invention.

FIG. 5 is a flowchart illustrating an alarm activation process, according to an embodiment of the present invention. Wireless and other sensors may send status information to a local control panel. An alarm situation may be detected by one or more sensors, at 510. The local control panel may communicate to a central security network of the present invention, at step 512. Communication may be established via radio modems, landlines (e.g., phone, cable, etc.), wireless (e.g., cellular, etc.), satellite and/or other methods of communication. The alarm situation and other information may be conveyed via one or more data packets, as shown by step 514. At step 516, the central security network of the present invention may query one or more user databases to access user information. At step 518, the alarm situation received by the central security network may be processed according to user-defined conditions and/or other information. The central security network of the present invention may then execute notifications and/or other information to one or more identified entities in the manner identified by the user and other relevant factors and data, as illustrated by step 520.

According to another embodiment of the present invention, a wireless communication device at a home security system may relay a direct wireless communication from a home security device to a user's mobile device (e.g., cell phone, pager, PDA, etc.). This feature of the present invention may ensure communication to the user via wireless communication in the event of power failures and other power cutoffs.

A control panel may communicate with a central security network via various types of connections. The control panel may have a built-in modem or other communication device. A data packet (or other form of information) may send various types of relevant information, such as one or more of identification number of the control panel, identification number of the device issuing the alarm, relevant information regarding the nature of the alarm, photos, video clips, images and/or other information to one or more receiving servers at the central security network. Upon receiving this data, the central security network may query a user (or other) database where the device ID may be associated with pertinent user information, including one or more of user's profile, preferences and/or permissions. Other relevant information may also be retrieved or made available. By retrieving this information, the central security network may determine how the system should react given a specific user and a specific type of alarm (e.g., smoke, motion, panic, etc.).

For example, when a smoke alarm goes off, a user may instruct a central security network to first contact the user's home to verify the alarm. If no one is home or the emergency situation was confirmed by someone at home, the central security network may directly contact a local fire department and provide the location, nature and/or other information related to the emergency. In addition, the central security network may notify the user's identified neighbors that they may be in danger in the event of an emergency, such as a fire alarm. A different set of conditions may apply if an aging relative with a heart condition activates a panic button or if an intruder were detected in the user's bedroom. Thus, a user may customize a response to an alarm situation or potential alarm situation, depending on various factors, such as the user's preferences, special needs and other relevant factors.

Alarm responses (e.g., alarm sound, emergency dispatch, notifications, etc.) may be based on user preferences and/or other factors and information. For example, an alarm may be activated at the detection of an alarm situation or after confirmation by the user. Also, the user may specify when emergency dispatch is to occur. For example, emergency dispatch may occur at the detection of an alarm situation, after confirmation by the user, after a predetermined period of time if the user cannot be reached or other user defined event or trigger. Thus, the present invention may assist the user in minimizing the penalties and fines associated with false alarms.

Figure 6:
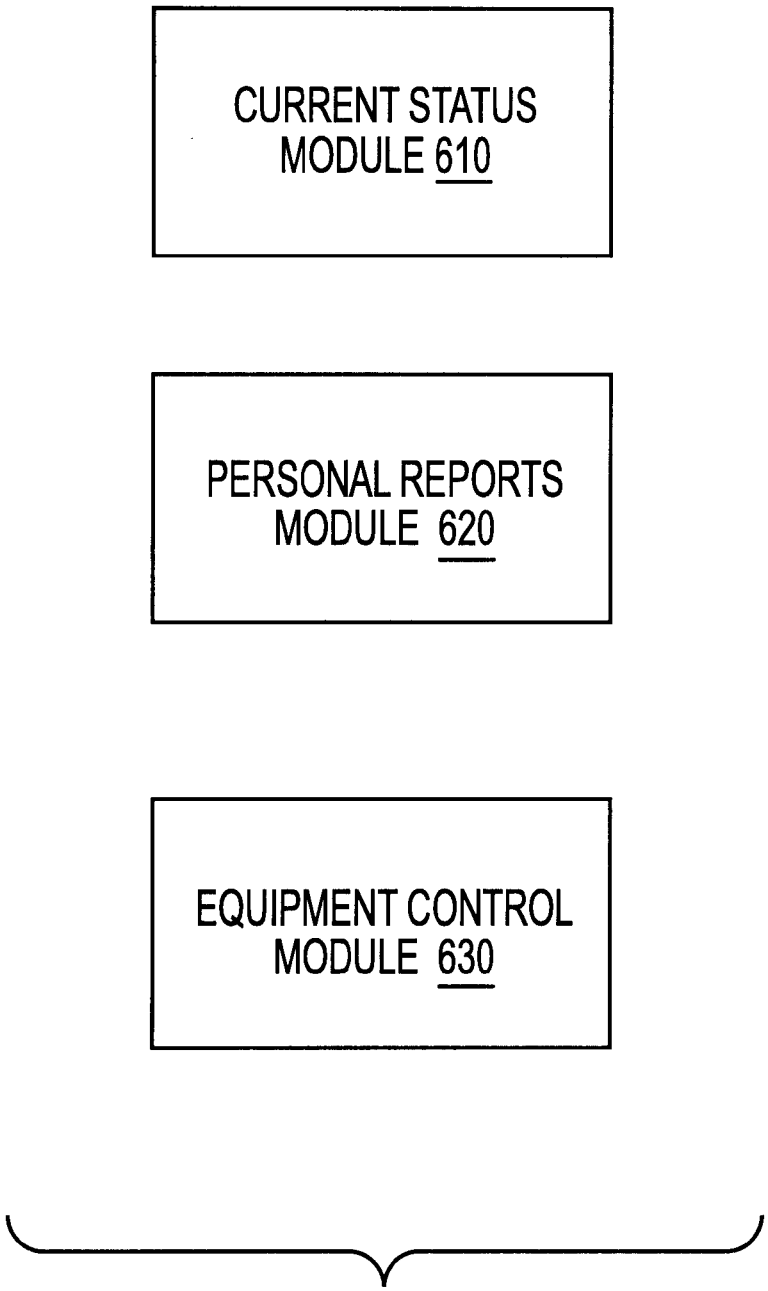
FIG. 6 is an example of a personal status page, according to an embodiment of the present invention.

FIG. 6 is an example of a personal status page, according to an embodiment of the present invention. A user of the present invention may access a web site (or other user interface) through the Internet or other communication means. A user may also access the network via a voice portal where information may be communicated to the user in a voice message. For example, a user may access a personal status page where personal information may be observed and analyzed. The personal status page may include various modules and functions, which may include a current status report module 610, personal reports module 620, equipment control module 630, and other modules and functions.

Current status report module 610 may enable a user or other authorized individuals or entities to view current security information for one or more registered security devices and/or systems. The current status page may include a current status report, showing each device on a system or network, device status and any relevant information about that device. For example, a user may select to view current information for an identified device, such as a motion sensor, at an identified location (e.g., house). An identified device may include motion sensors, door contacts, window contacts, etc. An identified location may include one or more of a house, office, vacation home, car, boat, family members or other individuals, and others. Summary information may be provided for situations that may be identified as alarm worthy events. This information may be personalized by the user. Further detailed information may be viewed for identified alarm situations and others. Detailed information may include video footage, photographs and other data.

Figure 7:
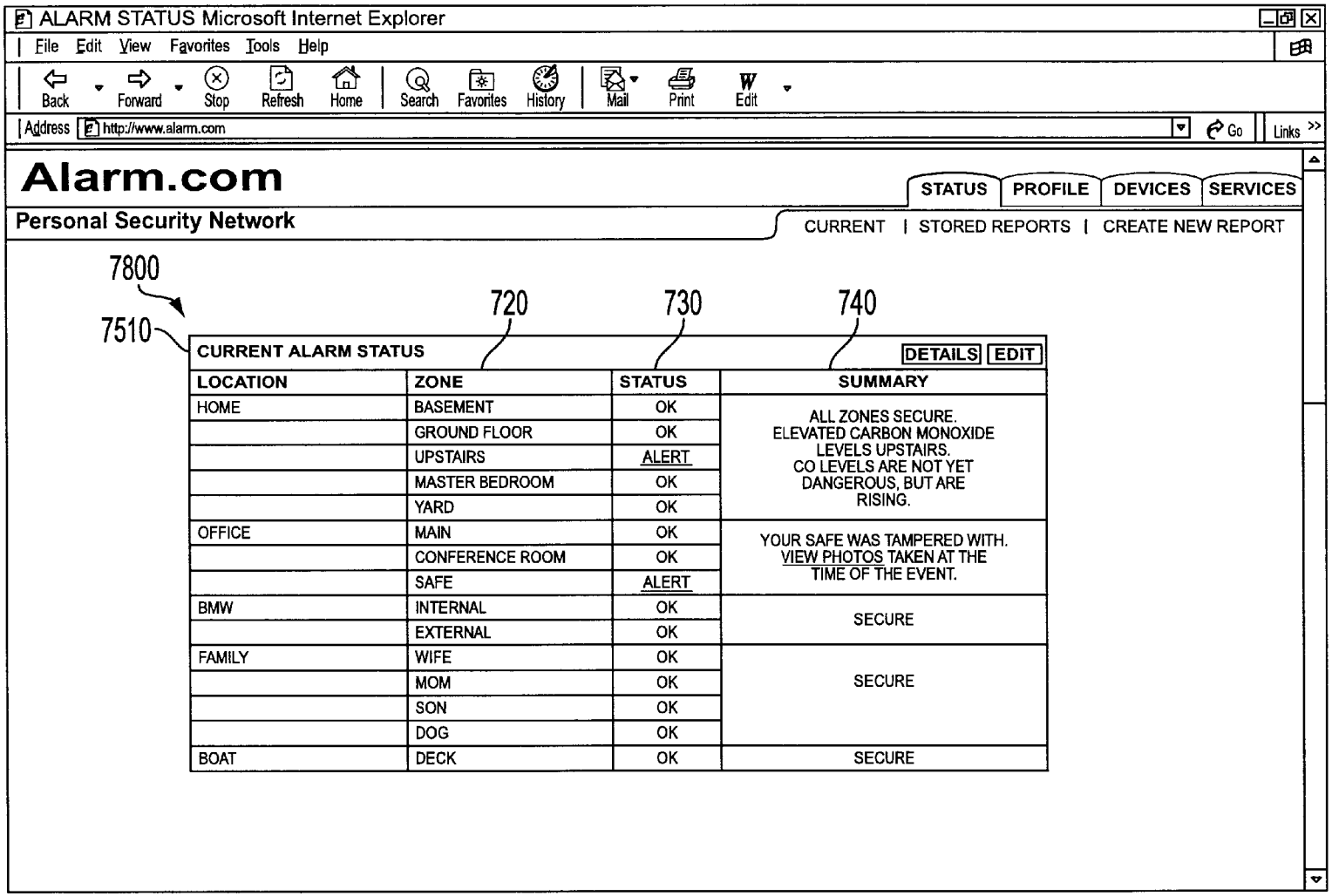
FIG. 7 is an example of a current status report, according to an embodiment of the present invention.

An example of a current status report may be illustrated in FIG. 7. Report 700 is an example of a personalized current status report for a user as may be viewed from a web site. It should be appreciated that when a web-based example is used, other user interfaces may also be used including telephone interfaces, mobile web, PDAs, etc. For example, location column 710 may list one or more locations that have been registered with the central security network of the present invention. For example, locations may include home, office, car, family members and other individuals, and boat. Other locations, objects, individuals may be registered with the system of the present invention. Zone 720 may list one or more areas monitored by one or more security devices.

The zone definitions may be identified and/or personalized by the user. For example, a zone may include an area within an identified location. For example, for the home location, zones 720 may include one or more of basement, ground flood, upstairs, master bedroom, and yard. Zones may also be defined by the user, depending on the number and monitoring capabilities of security devices within a location. Zones may also be defined as the area and/or events covered by a single device or group of security devices. For example, zones may be defined as front door, back door, garage door, basement door, windows (first level), windows (second level), etc. Other zones may be defined as fire, flood, temperature, gas, etc. Thus, a user's ability to monitor may be more detailed or broader in scope, depending on the user's preferences, user-defined zones and other information.

For each identified zone or group of zones within a location, current status information may be displayed. Current status information may include whether an alarm situation has been identified. For example, terms, phrases, symbols, and/or identifiers may be used to warn the user of an alarm situation or other alarm worthy events, as defined by the user. Different terms, phrases, symbols and/or identifiers may be used to indicate varying degrees of severity.

For example, when an alert situation is detected, the status column 730 may indicate such an event to the user. In the example of FIG. 7, the term "ALERT" may be displayed. By clicking on or otherwise selecting the alert notification entry in column 730, the user may receive details regarding the alert. Details regarding the alert notification may also be displayed in summary column 740. For example, the user may be informed that a safe was tampered with. The user may also have the option to view photographs and/or video clips at the time of the alarm incident. Other detailed information may be provided. For example, icons or other images may indicate status information, such as alarm, open, tampering, no AC power, shut, sensor bypassed, battery low, siren if alarm, contact if alarm, monitor and other status data for each sensor, group of sensors, for example.

In another example, the user may be informed that all zones are secure and that elevated levels of carbon monoxide have been detected in the upstairs zone of the user's home, where CO levels are rising but not yet dangerous. Other detailed information may be viewed by accessing the alert notification (e.g., clicking on the term "ALERT"). For example, the user may view CO level readings and the relation of current CO levels with levels that may be considered harmful. The user may also access preventive information, which may include instructions, contact information and other information to enable the user remedy the alert situation.

Other events may also be reported and tracked. For example, a user may generate reports for event types, such as the opening of the kitchen door, garage door, for example. Other actions and events may be tracked. Details and other data may be provided, such as date and time of the occurrence. Thus, a detailed log of events detected by security and other devices may be reported and tracked at user defined levels of detail. For example, a user may select or identify report factors, which may include type of event, type of device, unit or system, time period(s), display order, and/or other details. Type of event may include off, tripped, value, fire, battery, AC, malfunction, tamper, disarming, arming stay, arming away, arming failed, disarming failed, sensor bypassed, programming, open and others. Type of device may include smoke, heat, CO, radon, temperature, contact, motion, camera, breakage, sound, panic button, control, light and others.

In addition to the current status report, a user may generate personal reports for informative and precautionary purposes. Personal reports module 620 enable a user or other authorized individuals or entities to generate reports based on current and historical security information from one or more entities registered with the central security network of the present invention. Personalized reports may be generated based on variables, such as time and location. For example, a user may want to view a report showing motion detected in the yard (the location) over the past month (the time).

In another example, a user may request reports based on aggregate data. Aggregate data may include data and/or statistics from other sources within the central security network of the present invention. The user may want to view more general reports derived from the entire network, not just the user's own system. For example, a user may generate a report based on the break-ins within a 5 mile radius of the user's home address within the last 6 months. Other data and demographics may be used to display various graphs, chart, reports and other formats for analysis. An example of a network-dependent report may include a map (or other graphic) showing all of the burglaries that have taken place within 10 miles (or other distance) of the user's home (or other identified location) within the last six months. (or other time period or event). Detail information for each alert event may also be provided. For example, a fire icon may represent a fire accident within a user defined location. Further details regarding the exact location of the fire, when the event occurred, police reports and other relevant data may be presented. Links to news bulletins, prevention data and other information may be provided as well. In addition, users may generate and save customized reports to be accessed through the web interface of the present invention. In another example, a user may request a map where recent assaults have occurred in or near the user's neighborhood in the last 3 months.

According to an embodiment of the present invention, the user may aggregate security and/or other data from various sources (e.g., external sources) to generate customized reports regarding issues of concern. Other sources of information may include public records, police reports and other data. This feature of the present invention provides users (and/or other authorized individuals and/or entities) the ability to analyze data on varying levels of detail and user-defined factors.

Figure 8:
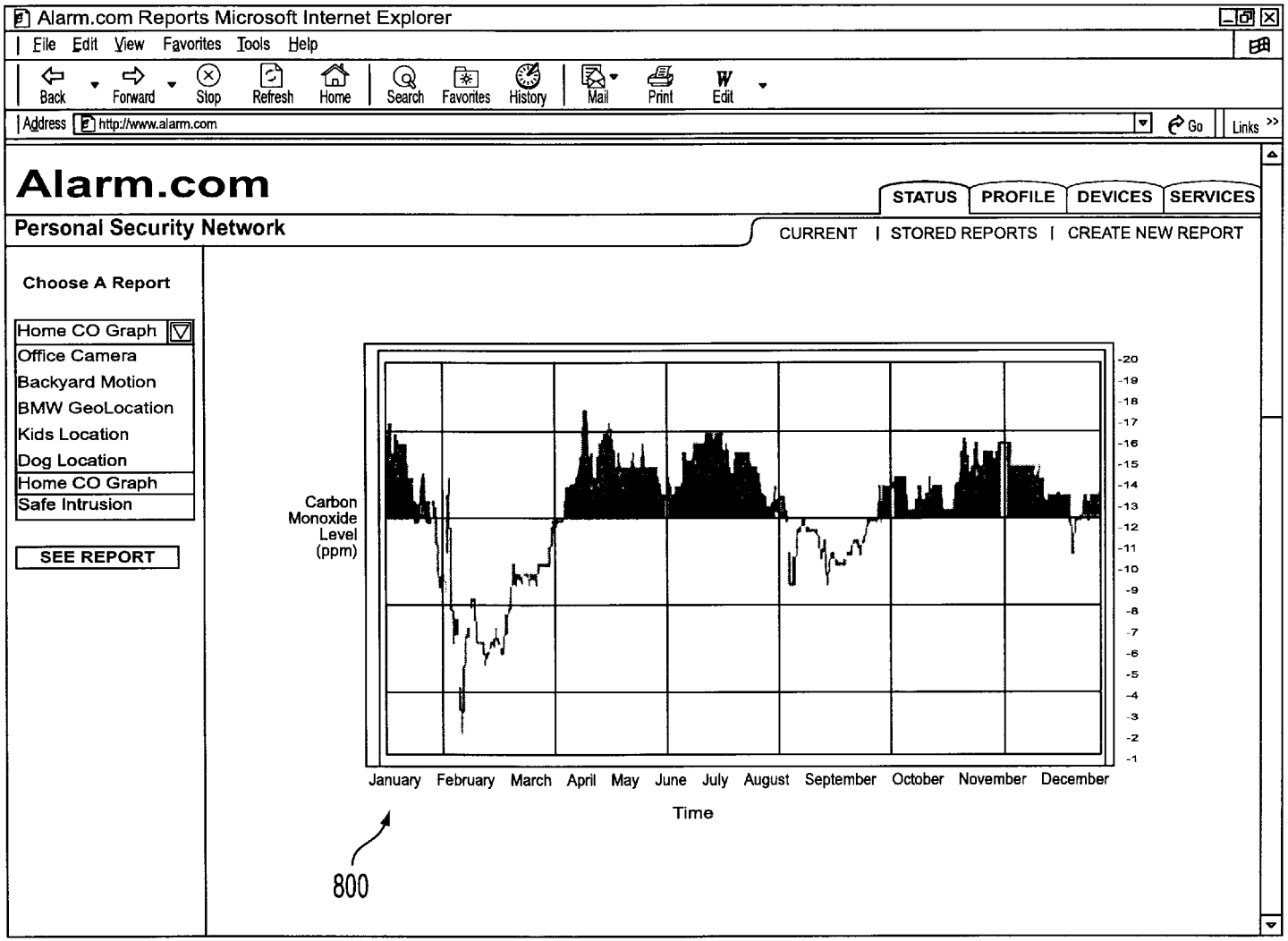
FIG. 8 is an example of a personal report based on current, historical and other data, according to an embodiment of the present invention.

FIG. 8 is an example of a personal report based on current, historical and other data, according to an embodiment of the present invention. For example, a user may generate various reports, such as a home CO graph, office camera, backyard motion, car location, individual location, pet location, and safe intrusion, for example. Data regarding other events under surveillance by the user may be used to generate other user-defined graphs, charts and other formats of data.

In another example, the user may request scheduled services which may include a generation of regular reports about selected security issues or status information. For example, a user may request a report of local break-ins which may be generated and conveyed to the user at pre-determined intervals, such as every week. Reports may also be generated at the occurrence of a triggering event, such as an alarm situation. For example, at the occurrence of a police response to an alarm, the system may generate an updated report including the most recent police response or other identified trigger within the user's defined area of interest. Other triggers and user-defined preferences may be defined.

Equipment Control module 630 may enable a user to control various appliances and devices within a user's home or other location. For example, devices may include lights, televisions, VCRs, heating, ventilation, air conditioning, home entertainment units and other devices. Appliances may include stove, gas range, iron, and others. Through the present invention, the user may control these appliances and devices remotely. For example, while the user is away on an extended trip, the user may want the user's home to appear "lived-in." Thus, the present invention enables users to control appliances, devices and other objects remotely so that potential intrusions and/or burglaries may be avoided. For example, this feature of the present invention may also include the ability to turn devices on and off and manipulate lighting in the home or other location. The present invention may also enable the user to implement a schedule at which to activate one or more devices. For example, the heating may be turned on every morning at 6:00 a.m. and turned off every night at 10:00 p.m., as defined by the user's schedule. Also, the porch lights may be activated every night at 6:00 p.m. and turned off at 6:00 a.m.

Figure 9:
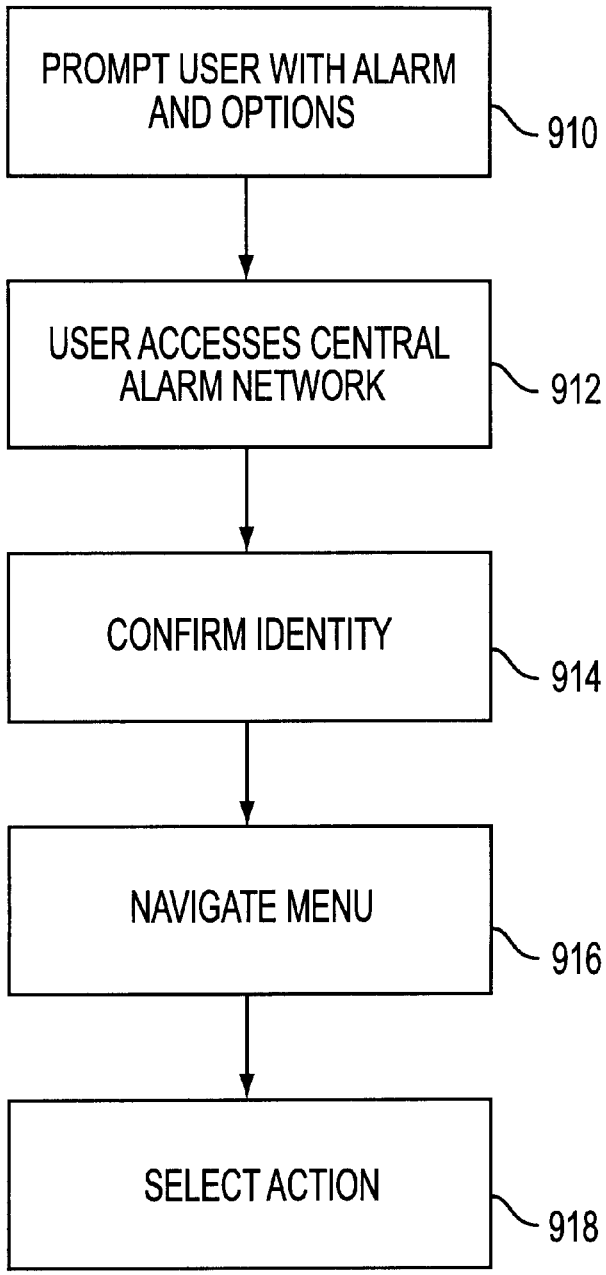
FIG. 9 is a flowchart illustrating a process for accessing a security system, according to an embodiment of the present invention.

FIG. 9 is a flowchart illustrating a process for accessing a security system, according to an embodiment of the present invention. At step 910, a user may be presented with an alarm notification and various options. The user may be notified via pre-selected methods of communication. For example, the user may request to be notified via pager, cell phone or other form of wireless and other communication. For example, the user may receive a notification with options where the options may include notifying a spouse, notifying neighbors and other options. At step 912, a user may access a central security network of the present invention, via various forms of communication, such as WAP, Internet, voice portal and other methods. At step 914, the user may be asked to confirm the user's identify for access authorization. For example, the user may be asked to provide a password, PIN or other form of identification. This information may be checked against the user's database and/or other subscriber information.

At step 916, the user may be permitted to navigate through the option menus to retrieve relevant and important information. Depending on the medium of communication (e.g., wireless, voice, Internet, etc.) the user may navigate through possible choices via voice, keypads, number selection and other selection methods. For example, a user may be alerted via a mobile device (e.g., a cell phone) that an intruder has been detected at the user's home. Menu options may include selecting (e.g., pressing or saying) 1 to alert the authorities; selecting 2 to deactivate the alarm, and other options. In another example, a user may be alerted that an attempted burglary took place on the user's street last night. Menu options may include selecting 1 to notify the user's wife, selecting 2 to check the user's alarm system status and other options. Menu options may be predetermined based on user profile and other data. Menu options may also vary on the type of alarm event detected.

The present invention enables a user to monitor and automate home, business and other locations or objects from a remote location via a voice portal. For example, a user may perform various options, including the ability to arm and disarm security system and/or individual devices, turn lights on and off, and check current system status. The security service of the present invention allows a user to interact with a security system via voice messages. Voice shortcuts may also be created to enable users to punch in a code (e.g., 2 digit code) assigned by the user for certain tasks. For example, code 77 may turn off bedroom lights, code 78 may disarm the security system, and 79 may turn on the coffee maker. Features are customizable to a user's schedule and needs.

At step 918, the user may select the appropriate one or more actions. For example, the user may be notified of a possible break-in. The user may then select to view an image (e.g., photo, video, etc.) taken of the area associated with the alert at the time of the possible break-in. The user may then execute an appropriate action. For example, if the user views an image of a pet knocking over a lamp which falls and breaks a window, the user may cancel the alarm and emergency notification. Thus, police resources may be conserved and the user may avoid a penalty fine for a false alarm. Other actions may include a confirmation response where the user may confirm the emergency thereby allowing police (or other emergency) dispatch. The user may also provide feedback or request further information. Other options may also be available. To provide the functionality of a telephone-based output with user interaction, a voice delivery system, such as Microstrategy's Telecaster™ system, may be employed.

Figure 10:
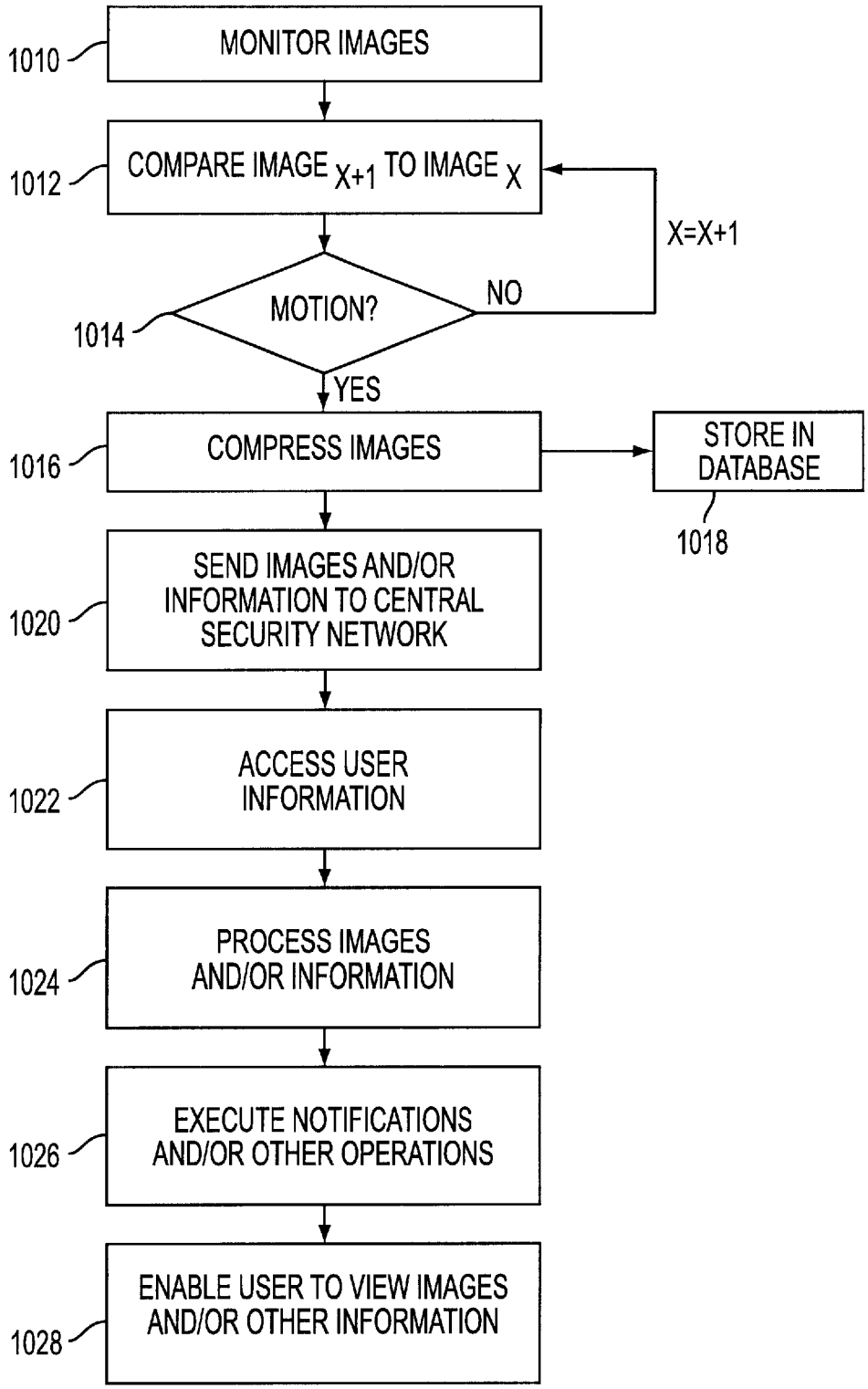
FIG. 10 is a flowchart illustrating a process for accessing video images provided by a security system, according to an embodiment of the present invention.

FIG. 10 is a flowchart illustrating a process for accessing video images provided by a central system network, according to an embodiment of the present invention. Users may monitor an identified location by using video or other similar recording device. The video feature of the central security network of the present invention may compare images. For example, if a change between images is detected, a recording may be triggered. The video clips of movement may be stored or sent to a server of a central security network. The user may then be notified according to predefined notification methods.

At step 1010, an identified location may be monitored by a video or other recording device. At step 1012, video images may be compared to detect motion or other event. For example, an image taken at time X+1 may be compared to a previous image taken at time X. The interval of comparison may be predetermined. In addition, the interval of comparison may be defined based on various factors, such as the importance of the property being monitored. For example, if motion is detected, an alarm may be triggered. In addition, the recorded images (e.g., video clips) may be compressed, at step 1016, to reduce the amount of data that may be stored in a database, as shown by step 1018, and/or sent to a central security network, as shown by step 1020. At step 1022, user information may be accessed to determine an appropriate response. For example, user information may include user profile, preferences, permissions and/or other information. At step 1024, the image (e.g., video clips) may be processed to determine whether certain user defined conditions are met for alarm triggers and other actions. Notifications and/or other actions may be executed at step 1026. At step 1028, the user may view video clips, images and/or other information remotely via various forms of communication, including wireless devices or the image may be automatically transmitted to the user at a selected device.

Figure 11:
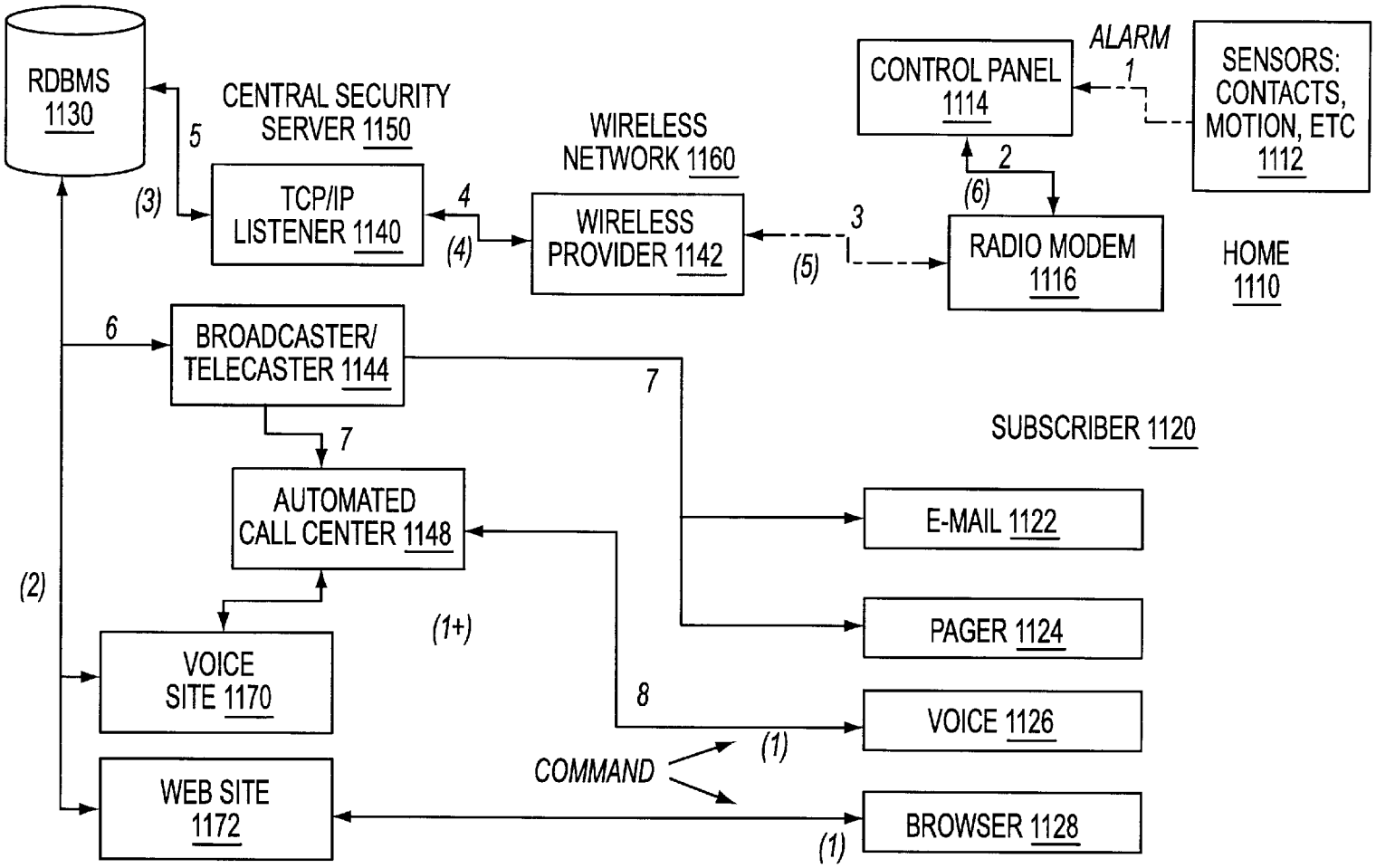
FIG. 11 is an example of an alarm flow diagram, according to an embodiment of the present invention.

FIG. 11 is an example of an alarm flow diagram, according to an embodiment of the present invention. Alarm and other data may be transmitted from a location, such as home 1110, to subscriber 1120 or other identified entities via central security server 1150. Data from subscriber 1120 may also be communicated to home devices via central security server 1150. Wireless communication with home 1110 may be established via wireless network 1160, which may include a wireless provider 1142 for wireless notification and user interaction.

For alarm notification, security devices 1112, such as sensors, contacts, motion detectors, etc., may transmit alarm data to control panel 1114. Other devices may also be implemented for monitoring and other functions. For example, security and other devices may transmit data to control panel 1114 to indicate events, such as a door or window opening and/or closing. Other events may be monitored. Control panel 1114 may then transmit alarm and/or other data to radio modem 1116. Radio modem 1116 may wirelessly transmit data via a wireless provider 1142 to establish communication with central security server 1150. Wireless data may be transmitted to TCP/IP listener 1140, which may then communicate relevant data via relational database 1130. Profile and other data from database 1130 may then be transmitted to Broadcaster 1144 for the automatic generation of personalized output from an on-line analytical processing system, according to the functionality provided in U.S. Pat. No. 6,154,766, which is directed to Broadcaster™ provided by Microstrategy™. For electronic notification, data may be transmitted to subscriber 1120 via e-mail 1122, pager 1124 and other formats.

According to another embodiment of the present invention, voice alerts may be provided via Microstrategy Telecaster™ 1144, which proactively delivers personalized information from a data warehouse to a voice receiver, such as a cell phone, telephone, etc. Telecaster 1144 may transmit personalized voice data to Automated Call Center 1148 which then provides a voice message to a voice enabled device, as illustrated by 1126. The transmitted voice data may be interactive to enable the subscriber to respond to the voice data, via voice, keypad or other format.

In addition, subscriber 1120 may initiate a command, request monitor data, report data and other information via Browser 1128. For example, subscriber 1120 may view monitor and other data, submit requests and perform other operations via web site 1172 provided by central security server 1150. In addition, subscriber 1120 may submit a voice request, as illustrated by voice 1126, which may be accepted by Automated Call Center 1148 where voice messages may be sent or retrieved via voice site 1170. Status data, monitor data and other information may be accessed from database 1130. In addition, commands, such as activate alarm, turn off lights, etc., may be verbally or otherwise communicated to voice site 1170. User requests and other data may be transmitted from voice site 1170, web site 1172 and other user interface to database 1130 where user profile data and other relevant information may be retrieved.

If an action is requested by subscriber 1120, central security server 1150 may forward the request data to an identified location, such as home 1110, via TCP/IP listener 1140. A wireless request or other data may be transmitted via wireless provider 1142 to radio modem 1116. Control panel 1114 may then carry out the user's request, which may include an activation request and/or other operations.

Figure 12A:
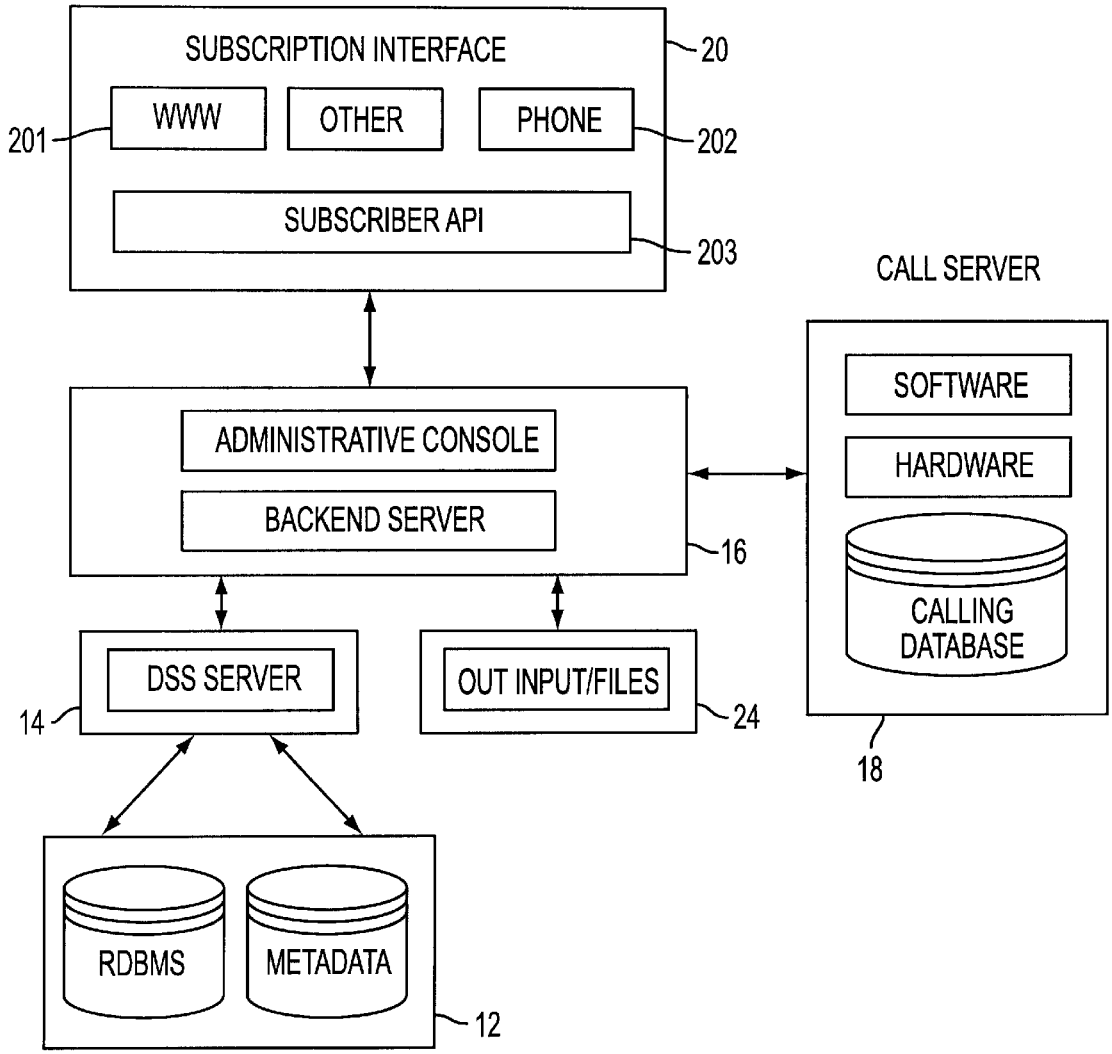
FIG. 12*a* is a schematic block diagram of a voice system, according to an embodiment of the present invention
Figure 12B:
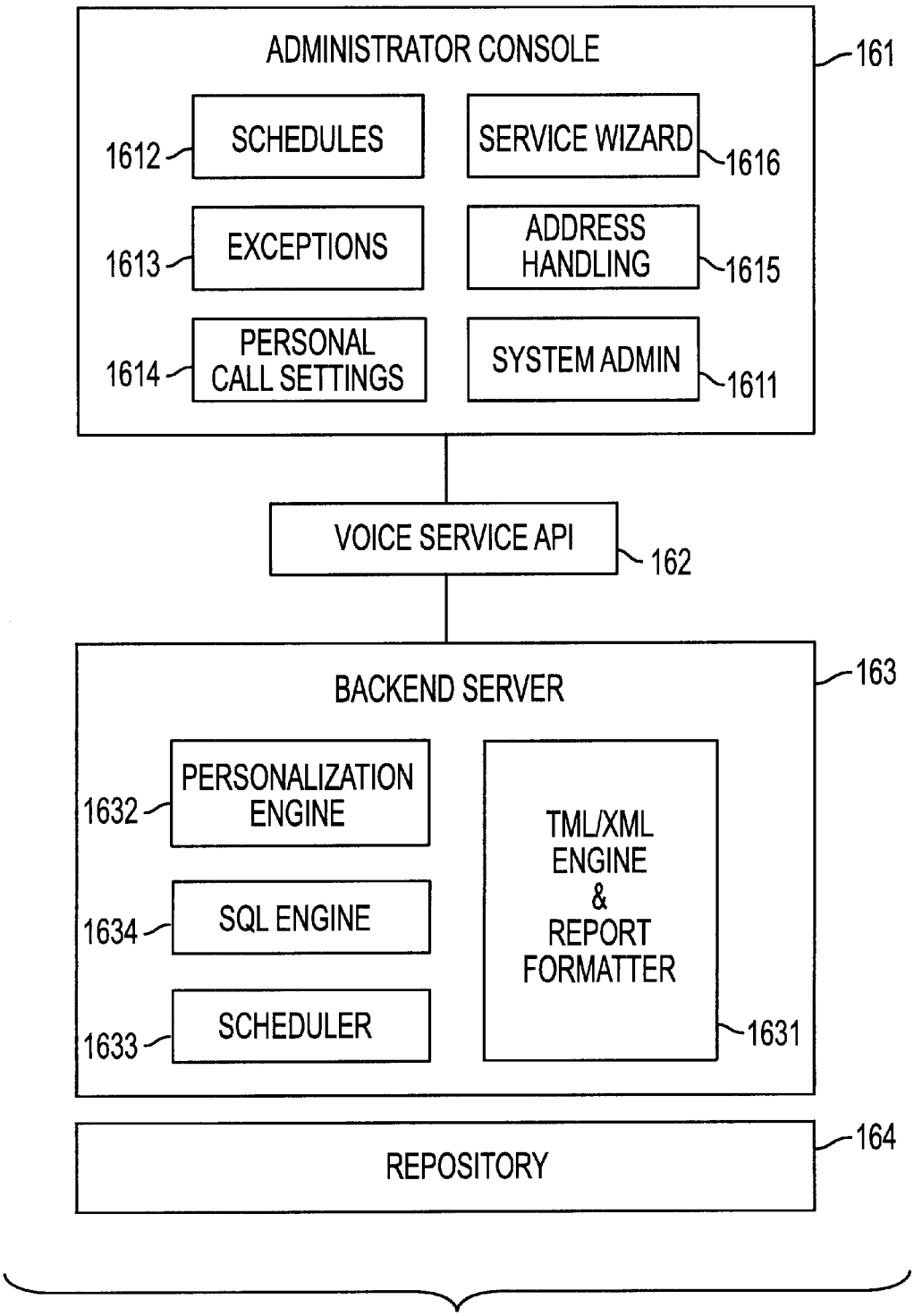
FIG. 12*b* is a schematic block diagram of an intelligence server, according to an embodiment of the present invention.
Figure 12C:
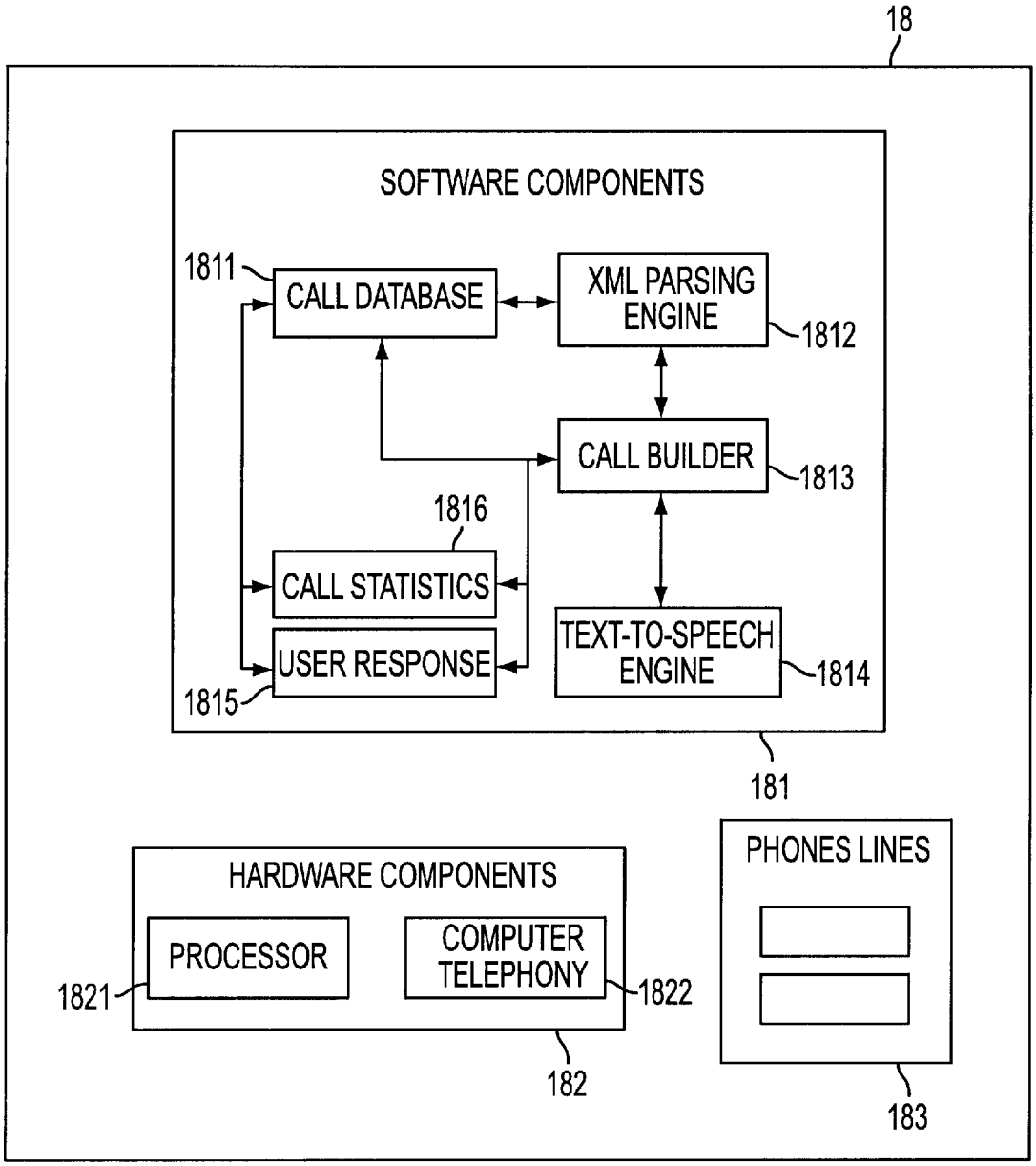
FIG. 12*c* is a schematic block diagram of call server, according to an embodiment of the present invention.

According to the functionality provided in FIGS. 12*a*–12*c*, the system of the present invention provides deployment of personalized, dynamic and interactive voice services.

FIG. 12*a* depicts an embodiment of a voice system, according to an embodiment of the. present invention. Preferably, the system comprises database system 12, a DSS server 14, voice service server 16, a call server 18, subscription interface 20, and other input/files 24.

Database system 12 and DSS server 14 comprise an on-line analytical processing (OLAP) system that generates user-specified reports from data maintained by database system 12. Database system 12 may comprise any data warehouse or data mart as is known in the art, including a relational database management system (RDBMS), a multidimensional database management system (MDDBMS) or a hybrid system. DSS server 14 may comprise an OLAP server system for accessing and managing data stored in database system 12. DSS server 14 may comprise a ROLAP engine, MOLAP engine or a HOLAP engine according to different embodiments. Specifically, DSS server 14 may comprise a multithreaded server for performing analysis directly against database system 12. According to one embodiment, DSS server 14 comprises a ROLAP engine known as DSS Server™ offered by MicroStrategy.

Voice service server (VSS) 16, call server 18 and subscription interface 20 comprise a system through which subscribers request data and reports e.g., OLAP reports through a variety of ways and are verbally provided with their results through an interactive voice broadcast (IVB). During an IVB, subscribers receive their requested information and may make follow-up requests and receive responses in real-time as described above. Although the system is shown, and will be explained, as being comprised of separate components and modules, it should be understood that the components and modules may be combined or further separated. Various functions and features may be combined or separated.

Subscription interface 20 enables users or administrators of the system to monitor and update subscriptions to various services provided through VSS 16. Subscription interface 20 includes a world wide web (WWW) interface 201, a telephone interface 202, other interfaces as desired and a subscriber API 203. WWW interface 201 and telephone interface 202 enable system 100 to be accessed, for example, to subscribe to voice services or to modify existing voice services. Other interfaces may be used. Subscriber API 203 provides communication between subscription interface 20 and VSS 16 so that information entered through subscription interface 20 is passed through to VSS 16.

Subscription interface 20 is also used to create a subscriber list by adding one or more subscribers to a service. Users or system administrators having access to VSS 16 may add multiple types of subscribers to a service such as a subscriber from either a static recipient list (SRL) (e.g., addresses and groups) or a dynamic recipient list (DRL) (described in further detail below). The subscribers may be identified, for example, individually, in groups, or as dynamic subscribers in a DRL. Subscription interface 20 permits a user to specify particular criteria (e.g. filters, metrics, etc.) by accessing database system 12 and providing the user with a list of available filters, metrics, etc. The user may then select the criteria desired to be used for the service. Metadata may be used to increase the efficiency of the system.

A SRL is a list of manually entered names of subscribers of a particular service. The list may be entered using subscription interface 20 or administrator console 161. SRL entries may be personalized such that for any service, a personalization filter (other than a default filter) may be specified. A SRL enables different personalizations to apply for a login alias as well. For example, a login alias may be created using personalization engine 1632. Personalization engine 1632 enables subscribers to set preferred formats, arrangements, etc. for receiving content. The login alias may be used to determine a subscriber's preferences and generate service content according to the subscriber's preferences when generating service content for a particular subscriber.

A DRL may be a report which returns lists of valid user names based on predetermined criteria that are applied to the contents of a database such as database system 12. Providing a DRL as a report enables the DRL to incorporate any filtering criteria desired, thereby allowing a list of subscribers to be derived by an application of a filter to the data in database system 12. In this manner, subscribers of a service may be altered simply by changing the filter criteria so that different user names are returned for the DRL. Similarly, subscription lists may be changed by manipulating the filter without requiring interaction with administrator console 161. Additionally, categorization of each subscriber may be performed in numerous ways. For example, subscribers may be grouped via agent filters. In one specific embodiment, a DRL is created using DSS Agent™ offered by MicroStrategy.

VSS 16 is shown in more detail in FIG. 12*b*. According to one embodiment, VSS 16 comprises administrator console 161, voice service API 162 and backend server 163. Administrator console 161 is the main interface of system 100 and is used to view and organize objects used for voice broadcasting. Administrator console 161 provides access to a hierarchy of additional interfaces through which a system administrator can utilize and maintain system 100. Administrator console 161 comprises system administrator module 1611, scheduling module 1612, exceptions module 1613, call settings module 1614, address handling module 1615, and service wizard 1616.

System administrator module 1611 comprises a number of interfaces that enable selection and control of the parameters of system 100. For example, system administrator module 1611 enables an administrator to specify and/or modify an email system, supporting servers and a repository server with which system 100 is to be used. System administrator 1611 also enables overall control of system 100. For example, system administrator module is also used to control the installation process and to start, stop or idle system 100. According to one embodiment, system administrator 1611 comprises one or more graphical user interfaces (GUIs).

Scheduling module 1612 comprises a number of interfaces that enable scheduling of voice services. Voice services may be scheduled according to any suitable methodology, such as according to scheduled times or when a predetermined condition is met. For example, the predetermined condition may be a scheduled event (time-based) including, day, date and/or time, or if certain conditions are met. In any event, when a predetermined condition is met for a given service, system 100 automatically initiates a call to the subscribers of that service. According to one embodiment, scheduling module 1612 comprises one or more GUIs.

Exceptions module 1613 comprises one or more interfaces that enable the system administrator to define one or more exceptions, triggers or other conditions. According to one embodiment, exceptions module 1613 comprises one or more GUIs.

Call settings module 1614 comprises one or more interfaces that enable the system administrator to select a set of style properties for a particular user or group of users. Each particular user may have different options for delivery of voice services depending on the hardware over which their voice services are to be delivered and depending on their own preferences. As an example of how the delivery of voice services depends on a user's hardware, the system may deliver voice services differently depending on whether the user 's terminal device has voice mail or not. As an example of how the delivery of voice services depends on a user's preferences, a user may chose to have the pitch of the voice, the speed of the voice or the sex of the voice varied depending on their personal preferences. According to one embodiment, call settings module 1614 comprises one or more GUIs.

Address handling module 1615 comprises one or more interface that enable a system administrator to control the address (e.g., the telephone number) where voice services content is to be delivered. The may be set by the system administrator using address handling module 1615. According to one embodiment, address handling module 1615 comprises one or more GUIs.

Voice service wizard module 1616 comprises a collection of interfaces that enable a system administrator to create and/or modify voice services. According to one embodiment, service wizard module 1616 comprises a collection of interfaces that enable a system administrator to define a series of dialogs that contain messages and inputs and determine the call flow between these dialogs based on selections made by the user. The arrangement of the messages and prompts and the flow between them comprises the structure of a voice service. The substance of the messages and prompts is the content of a voice service. The structure and content are defined using service wizard module 1616.

Voice service API 162 (e.g., MicroStrategy Telecaster Server API) provides communication between administrator console 161 and backend server 163. Voice Service API 162 thus enables information entered through administrator console 161 to be accessed by backend server 163 (e.g., MicroStrategy Telecaster Server).

Backend server 163 utilizes the information input through administrator console 161 to initiate and construct voice services for delivery to a user. Backend server 163 comprises report formatter 1631, personalization engine 1632, scheduler 1633 and SQL engine 1634. According to one embodiment, backend server 163 comprises MicroStrategy Broadcast Server. Report formatter 1631, personalization engine 1632, and scheduler 1633 operate together, utilizing the parameters entered through administrator console 161, to initiate and assemble voice services for transmission through call server 18. Specifically, scheduler 1633 monitors the voice service schedules and initiates voice services at the appropriate time. Personalization engine 1632 and report formatter 1631 use information entered through service wizard 1616, exceptions module 1613, call settings module 1614, and address module 1615, and output provided by DSS server 14 to assemble and address personalized reports that can be sent to call server 18 for transmission. According to one embodiment, report formatter 1631 includes an XML based markup language engine to assemble the voice services. In a particular embodiment, report formatter includes a Telecaster Markup Language engine offered by MicroStrategy Inc. to assemble the call content and structure for call server 18.

SQL engine 1634 is used to make queries against a database when generating reports. More specifically, SQL engine 1634 converts requests for information into SQL statements to query a database.

Repository 164 may be a group of relational tables stored in a database. Repository 164 stores objects which are needed by system 100 to function correctly. More than one repository can exist, but preferably the system 100 is connected to only one repository at a time.

According to one embodiment, a call server 18 is used to accomplish transmission of the voice services over standard telephone lines. Call server 18 is shown in more detail in FIG. 12*c*. According to one embodiment, call server 18 comprises software components 181 and hardware components 182. Software components 181 comprise call database 1811, mark-up language parsing engine 1812, call builder 1813, text-to-speech engine 1814, response storage device 1815 and statistic accumulator 1816.

Call database 1811 comprises storage for voice services that have been assembled in VSS 16 and are awaiting transmission by call server 18. These voice services may include those awaiting an initial attempt at transmission and those that were unsuccessfully transmitted (e.g., because of a busy signal) and are awaiting re-transmission. According to one embodiment, call database 1811 comprises any type of relational database having the size sufficient to store an outgoing voice service queue depending on the application. Call database 1811 also comprises storage space for a log of calls that have been completed.

Voice services stored in call database 1811 are preferably stored in a mark-up language. Mark-up language parsing engine 1812 accepts these stored voice services and separates the voice services into parts. That is, the mark-up language version of these voice services comprises call content elements, call structure elements and mark-up language instructions. Mark-up language parsing engine 1812 extracts the content and structure from the mark-up language and passes them to call builder 1813.

Call builder 1813 is the module that initiates and conducts the telephone call to a user. More specifically, call builder dials and establishes a connection with a user and passes user input through to markup language parsing engine 1812. In one embodiment, call builder 1813 comprises "Call Builder" software available from Call Technologies Inc. Call builder 1813 may be used for device detection, line monitoring for user input, call session management, potentially transfer of call to another line, termination of a call, and other functions.

Text-to-speech engine 1814 works in conjunction with mark-up language parsing engine 1812 and call builder 1813 to provide verbal communication with a user. Specifically, after call builder 1813 establishes a connection with a user, text-to-speech engine 1814 dynamically converts the content from mark-up language parsing engine 1812 to speech in real time.

A voice recognition module may be used to provide voice recognition functionality for call server 181. Voice recognition functionality may be used to identify the user at the beginning of a call to help ensure that voice services are not presented to an unauthorized user or to identify if a human or machine answers the call. This module may be a part of call builder 1813. This module may also be used to recognize spoken input (say "one" instead of press "1"), enhanced command execution (user could say "transfer money from my checking to savings"), enhanced filtering (instead of typing stock symbols, a user would say "MSTR"), enhanced prompting, (saying numeral values).

User response module 1815 comprises a module that stores user responses and passes them back to intelligence server 16. Preferably, this is done within an active voice page (AVP). During a telephone call, a user may be prompted to make choices in response to prompts by the system. Depending on the nature of the call, these responses may comprise, for example, instructions to buy or sell stock, to replenish inventory, or to buy or rebook an airline flight. User response module 1815 comprises a database to store these responses along with an identification of the call in which they were given. The identification of the call in which they were given is important to determining what should be done with these responses after the call is terminated. User responses may be passed back to intelligence server 16 after the call is complete. The responses may be processed during or after the call, by the system or by being passed to another application.

Statistics accumulator 1816 comprises a module that accumulates statistics regarding calls placed by call builder 1813. These statistics including, for example, the number of times a particular call has been attempted, the number of times a particular call has resulted in voice mail, the number of times a user responds to a call and other statistics, can be used to modify future call attempts to a particular user or the structure of a voice service provided to a particular user. For example, according to one embodiment, statistics accumulator 1816 accumulates the number of times a call has been unsuccessfully attempted by call builder 1813. This type of information is then used by call server 18 to determine whether or not the call should be attempted again, and whether or not a voice mail should be left.

Call server 18 also comprises certain hardware components 182. Hardware components 182 comprise processor 1821 and computer telephone module 1822. According to one embodiment, processor 1821 comprises a Pentium II processor, available from Intel, Inc. Module 1822 provides voice synthesis functionality that is used in conjunction with Text to Speech engine 1814 to communicate the content of voice services to a user. Module 1822 preferably comprises voice boards available from Dialogic, Inc. Other processors and voice synthesizers meeting system requirements may be used.

The system and method of the present invention may form an integral part of an overall commercial transaction processing system.

According to one embodiment of the present invention, a system and method that enable closed-loop transaction processing are provided. The method begins with the deployment of an IVB by executing a service. As detailed above, this includes generating the content and combining this with personalization information to create an active voice page. Call server 18 places a call to the user. During the call, information is delivered to the user through a voice-enabled terminal device (e.g., a telephone or cellular phone).

During the IVB, a user may request a transaction, service, further information from the database or other request, e.g., based on options presented to the user. These will generically be referred to as transactions. The request may be, but is not necessarily, based on or related to information that was delivered to the user. According to one embodiment, the request comprises a user response to a set of options and/or input of information through a telephone keypad, voice input or other input mechanism. According to another embodiment, the request can be made by a user by speaking the request. Other types of requests are possible.

According to one embodiment, the user responses are written to a response collection, which along with information stored in the active voice page, can be used to cause a selected transaction to be executed. According to one embodiment, the active voice page comprises an XML-based document that includes embedded, generic requests, e.g., a request for a transaction, or a request for additional information (a database query). These embedded requests are linked with, for example option statements or prompts so that when a user enters information, the information is entered into the generic request and thus completes a specific transaction request. For example, in the example if a user exercises an option to buy a particular stock, that stock's ticker symbol is used to complete a generic "stock buy" that was embedded in the active voice page.

According to one embodiment, tokens are used to manage user inputs during the IVB. A token is a temporary variable that can hold different values during an IVB. When a user enters input, it is stored as a token. The token value is used to complete a transaction request as described above. According to one embodiment, the system maintains a running list of tokens, or a response collection, during an IVB.

In order to complete the requested transaction, the user responses (and other information from the active voice page) may need to be converted to a particular format. The format will depend, for example, on the nature and type of transaction requested and the system or application that will execute the transaction. For example, a request to purchase goods through a web-site may require the information to be in HTML/HTTP format. A request for additional information may require and SQL statement. A telephone-based transaction may require another format.

Therefore, the transaction request is formatted. According to one embodiment, the transaction is formatted to be made against a web-based transaction system. According to another embodiment, the transaction request is formatted to be made against a database. According to another embodiment, the transaction is formatted to be made against a telephone-based transaction system. According to another embodiment, the transaction is formatted to be made via e-mail or EDI. Other embodiments are possible.

In one embodiment, the formatted transaction request comprises an embedded transaction request. The system provides interactive voice services using TML, a markup language based on XML. Using TML active voice pages are constructed that contain the structure and content for a interactive voice broadcast including, inter alia, presenting the user with options and prompting the user for information. Moreover in connection with OPTION and PROMPT elements, active voice pages also can include embedded statements such as transaction requests. Therefore, the formatting for the transaction request can be accomplished ahead of time based on the particular types of transactions the user may select.

For example, in connection with an exemplary stock purchase, an active voice page can include an embedded transaction request to sell stock in the format necessary for a particular preferred brokerage. The embedded statement would include predefined variables for the name of the stock, the number of shares, the type of order (market or limit, etc.), and other variables. When the user chooses to exercise the option to buy or sell stock, the predefined variables are replaced with information entered by the user in response to OPTION or PROMPT elements. Thus, a properly formatted transaction request is completed.

TML parsing engine in call server 18 includes the functionality necessary to generate the properly formatted transaction request as described above. For example, in connection with the embodiment described above, the TML parsing engine shown in FIG. 3*c* reads the active voice pages. When the TML parsing engine reads an OPTION element that includes and embedded transaction request, it stores the transaction request, and defines the necessary variables and variable locations. When the user exercises that OPTION, the user's input is received by the TML parsing engine and placed at the memory locations to complete the transaction request This technique could be used, for example, to generate a formatted transaction request for web-site.

According to another embodiment, where the transaction request is made via a natural language, voice request, a formatted transaction request can be generated in a number of ways.

According to one embodiment, speech recognition technology is used to translate the user's request into text and parse out the response information. The text is then used to complete an embedded transaction request as described above. According to another embodiment, speech recognition software is used to translate the request to text. The text is then converted to a formatted request based on a set of known preferences.

A connection is established with the transaction processing system. This can be accomplished during, or after the IVB. According to one embodiment, the transaction processing system comprises a remotely located telephone-based transaction site. For example, call server 18, through the TML parsing engine 1812, establishes a connection with a telephone-based transaction processing site.

According to another embodiment, the transaction processing system comprises a remotely based web-site. According to this embodiment, the formatted request includes a URL to locate the web-site and the system accesses the site through a web connection using the formatted request. Alternatively, the formatted request includes an e-mail address and the system uses any known email program to generate an e-mail request for the transaction.

After the connection is established, the transaction is processed by the transaction processing site and the user is notified of the status of the transaction. If the transaction is completed in real-time, the user may be immediately notified. If the transaction is executed after the IVB, the user may be called again by the system, sent an e-mail, or otherwise notified when the transaction has been completed.

According to one particular embodiment, the system comprises an interactive voice broadcasting system and the transaction is accomplished in real-time. In this embodiment, confirmation of the transaction is returned to TML parsing engine 1812 shown in FIGS. 12*a–c* and translated to speech in text-to-speech engine 1814 and presented to the user during the IVB. More specifically, and similar to the process described with respect to embedded formatted transaction requests, TML also enables embedding of a response statement. Thus, when the transaction is processed and confirmation of the transaction is returned to the system, an embedded confirmation statement is conveyed to the user through TML parsing engine 1812 after being converted to speech in text-to-speech engine 1814.

The central security network of the present invention may operate through several distribution channels. For example, devices and/or services may be sold directly to end users over the Internet through an associated web site. The web site of the present invention may also be used to sell the alarm network service to individuals or entities who may already own alarm systems and are interested in the personalized monitoring feature of the present invention.

In another example, a distribution channel may involve an affiliate network which may include alarm dealers and installers. Because do-it-yourself wireless equipment may not meet everyone's needs, the present invention may have mini-partnerships with affiliates. Namely, the affiliate may retain the revenue for selling and installing the devices, and then refer the client to the alarm network of the present invention for monitoring and/or other services. As an incentive, an operator of a system according to the present invention may offer a referral program to reward affiliates for each client who subscribe to a service of the network.

In another example, the central security network may syndicate alarm services to current central monitoring stations, and thereby become an ingredient brand. For example, a major security entity may use services of the central security network as part of its service offering to the end consumer.

Other embodiments, uses and advantages of the present invention will be apparent to those skilled in the art from consideration of the specification and practice of the invention disclosed herein. The specification and examples should be considered exemplary only. The intended scope of the invention is only limited by the claims appended hereto.

What is claimed is:

1. A system for automatic notification of security information to subscribed users based on user specified information wherein the security information is communicated over at least one wireless communication path from security devices associated with the subscription comprising:

a user profile storage system for storing user profile information based on a user subscription wherein profile information comprises notification preferences assigning one or more alarm situations to one or more remote security devices and defining how the subscriber is to be notified when the one or more alarm situations occurs; and a security control system that receives wireless communications that include security device information associated with the one or more remote security devices associated with a subscribed user, processes the security device information from the one or more remote security devices and automatically notifies the subscribed user associated with the remote security devices when an alarm event satisfying the user notification preferences is received from the one or more remote security devices.

2. The system of claim 1 wherein notification preferences comprise providing alarm notification via a wireless device through a wireless channel.

3. The system of claim 2 wherein the wireless device comprises one or more of mobile phone, pager, email and PDA.

4. The system of claim 3 wherein the user is presented with one or more option responses which comprise one or more of confirmation of the alarm and cancellation of the alarm.

5. The system of claim 4 wherein option responses are selected via a voice portal where the user navigates through one or more voice menus.

6. The system of claim 5 wherein alarm information comprises one or more of nature of the alarm, date, location, and device that triggered the alarm.

7. The system of claim 2 wherein alarm notification is executed via a voice portal wherein a voice message provides alarm information.

8. The system of claim 1 wherein the remote security devices communicate wirelessly with a local control panel.

9. The system of claim 8 wherein the local control panel communicates the security device information wirelessly to the server control system.

10. The system of claim 1 further comprising an alarm database for storing information associated with the alarm event.

11. The system of claim 1 wherein the notification preferences comprises order of contact devices.

12. The system of claim 1 wherein the server system continues executing alarm notification until a user responds.

13. The system of claim 1 further comprising a report generator wherein aggregated data is used to generate one or more reports based on user defined factors.

14. The system of claim 13 wherein aggregated data comprises other security systems registered with the central security network.

15. The system of claim 13 wherein user defined factors comprise security events.

16. The system of claim 1 further comprising a report generator wherein a graphic of a user defined location displays user selected information based on aggregated data.

17. The system of claim 1 further comprising an application controller for monitoring one or more appliances.

18. The system of claim 17 wherein the wireless channel is used to monitor the one or more appliances comprising one or more of television, external lights, internal lights, video recorder, DVD player, oven, air conditioning, heating, ventilation, and water heater.

19. A user system through which a user accesses security information for one or more remote security devices over at least one wireless communication path comprising:

a user profile module for providing user profile information wherein profile information comprises notification preferences assigning one or more alarm situations to one or more remote security devices and defining how the subscriber is to be notified when the one or more alarm situations occurs;

a data access module to access a server control system that receives wireless communication including security device information associated with the one or more remote security devices associated with a user, processes the security device information from the one or more remote security devices and automatically notifies the user associated with the remote security devices when an alarm event satisfying the user notification preferences is received; and a display for displaying status information related to one or more remote devices.

20. The user system of claim 19 further comprising a notification module for assigning notification methods for user defined alarm events wherein the user is contacted via a wireless device through a wireless channel.

21. The user system of claim 20 wherein the notification module enables the user to assign at least one function to each remote security device.

22. The user system of claim 19 wherein a user confirms user identity information via one or more of PIN and password.

23. A method for automatic notification of security information to subscribed users based on user specified information wherein the security information is communicated over at least one wireless communication path from security devices associated with the subscription comprising the steps of:

storing user profile information based on a user subscription wherein profile information comprises notification preferences assigning one or more alarm situations to one or more remote security devices and defining how the subscriber is to be notified when the one or more alarm situations occurs;

receiving wireless communications that include security device information associated with the one or more remote security devices associated with a subscribed user;

processing the security device information from the one or more remote security devices; and automatically notifying the subscribed user associated with the remote security devices when an alarm event satisfying the user notification preferences is received from the one or more remote security devices.

24. The method of claim 23 wherein notification preferences comprise providing alarm notification via a wireless device through a wireless channel.

25. The method of claim 24 wherein the wireless device comprises one or more of mobile phone, pager, email and PDA.

26. The method of claim 25 wherein the user is presented with one or more option responses which comprise one or more of confirmation of the alarm and cancellation of the alarm.

27. The method of claim 26 wherein option responses are selected via a voice portal where the user navigates through one or more voice menus.

28. The method of claim 27 wherein alarm information comprises one or more of nature of the alarm, date, location, and device that triggered the alarm.

29. The method of claim 24 wherein alarm notification is executed via a voice portal wherein a voice message provides alarm information.

30. The method of claim 23 wherein the remote security devices communicate wirelessly with a local control panel.

31. The method of claim 30 wherein the local control panel communicates the security device information wirelessly to the server control system.

32. The method of claim 23 further comprising a step of storing information associated with the alarm event.

33. The method of claim 23 wherein the notification preferences comprises order of contact devices.

34. The method of claim 23 further comprising a step of continuing execution of the alarm notification until a user responds.

35. The method of claim 23 further comprising a step of generating a report wherein aggregated data is used to generate one or more reports based on user defined factors.

36. The method of claim 35 wherein aggregated data comprises other security systems registered with the central security network.

37. The method of claim 35 wherein user defined factors comprise security events.

38. The method of claim 23 further comprising a step of generating a report wherein a graphic of a user defined location displays user selected information based on aggregated data.

39. The method of claim 23 further comprising a step of monitoring one or more appliances.

40. The method of claim 39 wherein the wireless channel is used to monitor the one or more appliances comprising one or more of television, external lights, internal lights, video recorder, DVD player, oven, air conditioning, heating, ventilation, and water heater.

41. A user method through which a user accesses security information for one or more remote security devices over at least one wireless communication path comprising:

providing user profile information wherein profile information comprises notification preferences assigning one or more alarm situations to one or more remote security devices and defining how the subscriber is to be notified when the one or more alarm situations occurs;

accessing a server control system that receives wireless communication including security device information associated with the one or more remote security devices associated with a user, processes the security device information from the one or more remote security devices and automatically notifies the user associated with the remote security devices when an alarm event satisfying the user notification preferences is received; and displaying status information related to one or more remote devices.

42. The user method of claim 41 further comprising a step of assigning notification methods for user defined alarm events wherein the user is contacted via a wireless device through a wireless channel.

43. The user method of claim 42 further comprising a step of assigning at least one function to each remote security device.

44. The user method of claim 41 wherein a user confirms user identity information via one or more of PIN and password.

* * * * *